US010270180B2

(12) United States Patent
Kasahara

(10) Patent No.: US 10,270,180 B2
(45) Date of Patent: Apr. 23, 2019

(54) ANTENNA APPARATUS

(71) Applicant: NEC Corporation, Minato-ku, Tokyo (JP)

(72) Inventor: Yoshiaki Kasahara, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/111,235

(22) PCT Filed: Nov. 6, 2014

(86) PCT No.: PCT/JP2014/005592
§ 371 (c)(1),
(2) Date: Jul. 13, 2016

(87) PCT Pub. No.: WO2015/118586
PCT Pub. Date: Aug. 13, 2015

(65) Prior Publication Data

US 2016/0329639 A1 Nov. 10, 2016

(30) Foreign Application Priority Data

Feb. 4, 2014 (JP) ..... 2014-019266

(51) Int. Cl.
*H01Q 13/00* (2006.01)
*H01Q 13/22* (2006.01)
*H01Q 15/00* (2006.01)

(52) U.S. Cl.
CPC ..... *H01Q 13/22* (2013.01); *H01Q 15/0086* (2013.01)

(58) Field of Classification Search
CPC ..... H01Q 13/20; H01Q 13/06; H01Q 13/28; H01Q 1/48; H01Q 9/40; H01Q 1/246
(Continued)

(56) References Cited

U.S. PATENT DOCUMENTS 4,316,474 A 2/1982 Spethmann
7,592,957 B2 9/2009 Achour et al.
(Continued)

FOREIGN PATENT DOCUMENTS

JP 63-209206 A 8/1988
WO 2013/145842 A1 10/2013

OTHER PUBLICATIONS

International Search Report for PCT Application No. PCT/JP2014/005592, dated Jan. 20, 2015.

*Primary Examiner* — Dameon E Levi
*Assistant Examiner* — Collin Dawkins

(57) ABSTRACT

A plurality of unit structures, each including a first planar conductor, a second planar conductor arranged so as to be opposed to the first planar conductor, a first conductor connection part that connects the first planar conductor and the second planar conductor, a second conductor connection part that connects the first planar conductor and the second planar conductor in a position different from the position of the first conductor connection part, and an opening part that is held between the first conductor connection part and the second conductor connection part and is provided on the first planar conductor, are arranged in a direction perpendicular to a line segment that connects the first conductor connection part and the second conductor connection part and include unit structures including at least two or more types of opening parts, the shapes of which are different from one another.

10 Claims, 16 Drawing Sheets

(58) Field of Classification Search
USPC ..... 343/772, 844, 848, 700 MS
See application file for complete search history.

(56) References Cited

U.S. PATENT DOCUMENTS

2011/0134010 A1* 6/2011 Toyao ..... H01P 1/2005
343/844
2012/0287000 A1* 11/2012 Ando ..... H01Q 9/0407
343/700 MS
2013/0076582 A1* 3/2013 Nysen ..... H01Q 13/18
343/770

* cited by examiner

ANTENNA APPARATUS

This application is a National Stage Entry of PCT/JP2014/005592 filed on Nov. 6, 2014, which claims priority from Japanese Patent Application 2014-019266 filed on Feb. 4, 2014, the contents of all of which are incorporated herein by reference, in their entirety.

TECHNICAL FIELD

The present invention relates to an antenna apparatus, and more specifically, to an antenna apparatus that forms a leaky wave antenna.

BACKGROUND ART

A leaky wave antenna that uses a composite right/left-handed transmission line has been proposed as one of applications that use "metamaterials" formed of periodic structures sufficiently smaller than wavelengths of electromagnetic waves. The composite right/left-handed transmission line can be obtained by introducing capacitance components into a series part of a normal host line having a right-handed characteristic and introducing inductance components into a shunt part of the same host line.

For example, in a structure disclosed in the specification of U.S. Pat. No. 7,592,957 (Patent Literature 1), titled "ANNTENNAS BASED ON METAMATERIAL STRUCTURES", a capacitance between "Cell Conductive Patches" (conductive patches) and an inductance by a "Cell Conductive Via" (conductive via) are introduced into a microstrip line, which is a host line, whereby a Composite Right/Left-Handed (CRLH) transmission line is obtained.

In the composite right/left-handed transmission line, in a frequency band in which the phase of electromagnetic waves propagating through the transmission line matches the phase of electromagnetic waves that may exist in a free space, the electromagnetic waves propagating through the transmission line leak out to the free space. The antenna thus serves as the leaky wave antenna. The leaky wave antenna is able to efficiently radiate radio waves in a frequency region wider than that of normal resonant antennas. Further, the leaky wave antenna that uses the composite right/left-handed transmission line is able to radiate radio waves in broad angles from forward to backward with respect to the power propagation direction depending on the frequency.

CITATION LIST

Patent Literature

[Patent Literature 1] Specification of U.S. Pat. No. 7,592,957 (p 4-p 9)

SUMMARY OF INVENTION

Technical Problem

However, in the leaky wave antenna formed of the composite right/left-handed transmission line in which the microstrip line is used as the host line as disclosed in Patent Literature 1, it is difficult to control a radio wave radiation amount per unit length.

That is, in the leaky wave antenna disclosed in Patent Literature 1, radio waves are emitted from side surfaces of the microstrip line and the gap between the "Cell Conductive Patches" (conductive patches). Further, due to changes in a part where a strong current flows and a part where a strong electric field is generated depending on the frequency, a part from which the radio waves are emitted varies according to the change in the frequency. It is therefore difficult to specify the part from which the electromagnetic waves are emitted and to control the radio wave radiation amount.

One of the problems that occur due to the difficulty in controlling the radio wave radiation amount is a distortion of beams that are formed. In the leaky wave antenna, the electromagnetic waves are leaked to the free space as the electromagnetic waves propagate in the leaky wave antenna, which reduces the power in the leaky wave antenna. Therefore, in the leaky wave antenna in which the unit structures that are constituent elements of the antenna have the same radiation efficiency as in related art, the radiation amount of the electromagnetic waves becomes large around a power input side and becomes small around a power output side. Therefore, the beams that are formed are distorted.

OBJECT OF PRESENT INVENTION

The present invention has been made in view of the aforementioned problems and aims to provide an antenna apparatus, a wiring board, and an electronic device that achieve the leaky wave antenna in which the radio wave radiation amount per antenna length is controlled and the leaky wave antenna having antenna sections in which the radio wave radiation efficiencies per antenna length are different from one another.

Solution to Problem

In order to solve the aforementioned problem, an antenna apparatus according to the present invention mainly employs the following characteristic structures.

An antenna apparatus according to the present invention includes a plurality of unit structures, each of the unit structures being a constituent element and including:

a first planar conductor;

a second planar conductor that is provided so as to be opposed to the first planar conductor;

a first conductor connection part that connects the first planar conductor and the second planar conductor;

a second conductor connection part that is provided in a position different from the position of the first conductor connection part and connects the first planar conductor and the second planar conductor; and an opening part that is provided in an area on the first planar conductor, the area being sandwiched between the first conductor connection part and the second conductor connection part, in which:

the plurality of unit structures are arranged so that each of the first planar conductor and the second planar conductor of the unit structure forms one plane in a direction perpendicular to a line segment that connects the first conductor connection part and the second conductor connection part, and the plurality of unit structures include at least two or more types of opening parts, the shapes of which are different from one another.

Advantageous Effects of Invention

According to the antenna apparatus of the present invention, the waveguide formed of the first planar conductor, the second planar conductor, the first conductor connection part, and the second conductor connection part is used as the host line, the capacitance components are introduced into the series part of the host line by the opening part or a slit in the waveguide, and slits having shapes different from one another are included in one host line, whereby it is possible to obtain the leaky wave antenna in which the radio wave radiation amount per antenna length is controlled and to obtain the leaky wave antenna having antenna sections in which the radio wave radiation efficiencies per antenna length are different from one another.

DESCRIPTION OF EMBODIMENTS

Figure 1:
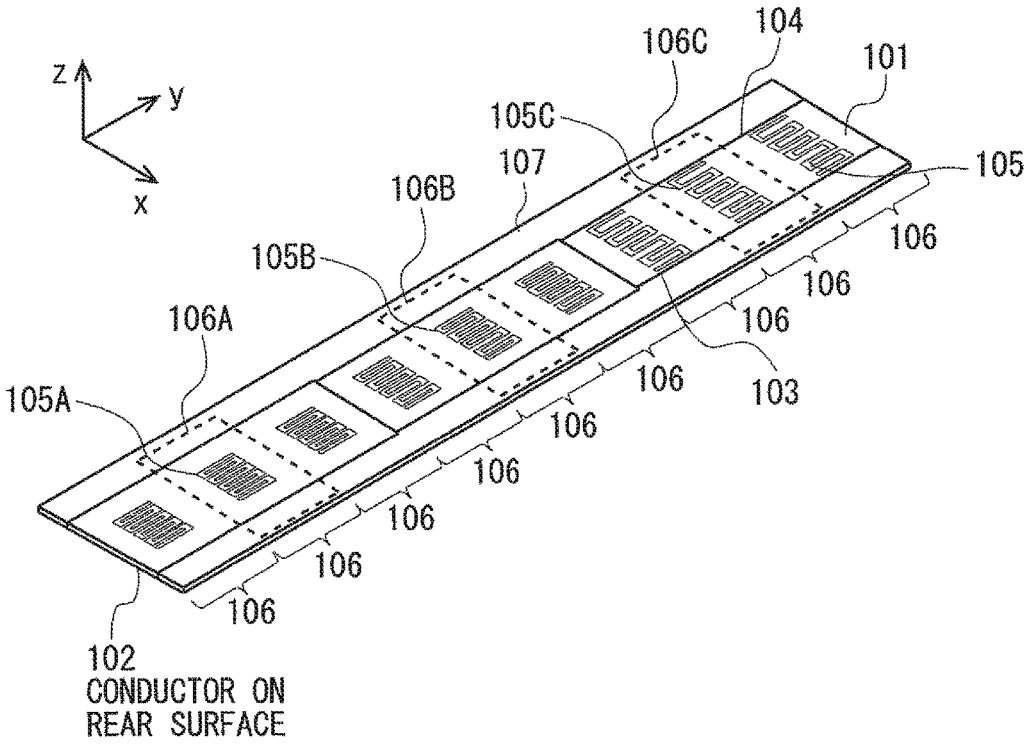
FIG. 1 is a schematic view showing one example of a perspective view of an antenna apparatus according to a first exemplary embodiment of the present invention.

Hereinafter, with reference to the accompanying drawings, preferable exemplary embodiments of an antenna apparatus according to the present invention will be described in detail. In the following description, the antenna apparatus according to the present invention will be described. Needless to say, however, the antenna apparatus may be mounted on a wiring board or an electronic device may be formed using the antenna apparatus. Further, in the drawings that are used in the following description, components that are shown in the plurality of drawings in common are denoted by the same reference symbols and descriptions thereof will be omitted. It is needless to say, however, that each drawing exemplifies one example of the exemplary embodiment of the present invention and does not limit the present invention.

(Characteristics of Present Invention)

Prior to a description of the exemplary embodiments of the present invention, the outline of characteristics of the present invention will be described first. The main characteristics of the present invention are as follows: the waveguide is used as the host line of the antenna apparatus, a slit is provided for each of the plurality of unit structures forming the waveguide, a plurality of capacitance components are introduced into the series part of the host line, and at least two slits having shapes different from one another are included in one host line, whereby it is possible to obtain the leaky wave antenna in which the radio wave radiation amount per antenna length is controlled and to obtain the leaky wave antenna having antenna sections in which the radio wave radiation efficiencies per antenna length are different from one another.

More specifically, the present invention includes an antenna apparatus including a plurality of unit structures, each of the unit structures being a constituent element and including: a first planar conductor; a second planar conductor that is provided so as to be opposed to the first planar conductor; a first conductor connection part that connects the first planar conductor and the second planar conductor; a second conductor connection part that is provided in a position different from the position of the first conductor connection part and connects the first planar conductor and the second planar conductor; and an opening part that is provided in an area on the first planar conductor, the area being sandwiched between the first conductor connection part and the second conductor connection part, in which: the plurality of unit structures are arranged so that each of the first planar conductor and the second planar conductor of the unit structure forms one plane in a direction perpendicular to a line segment that connects the first conductor connection part and the second conductor connection part, and the plurality of unit structures include at least two or more types of opening parts, the shapes of which are different from one another. The first planar conductor, the second planar conductor, the first conductor connection part, and the second conductor connection part form a waveguide.

That is, the main characteristics of the antenna apparatus according to the present invention are as follows: the waveguide formed of the first planar conductor, the second planar conductor, the first conductor connection part, and the second conductor connection part is used as the host line, the capacitance components are introduced into the series part of the host line by the opening part or a slit in the waveguide, and at least two types of slits having shapes different from one another are included in one host line, whereby it is possible to obtain the leaky wave antenna in which the radio wave radiation amount per antenna length is controlled and to obtain the leaky wave antenna having antenna sections in which the radio wave radiation efficiencies per antenna length are different from one another.

The present invention may provide a wiring board on which the aforementioned antenna apparatus is mounted or an electronic device that includes the aforementioned antenna apparatus.

How the present invention acts and how it allows for the control of the radiation efficiency per length in the leaky wave antenna will be further described in detail. In general, the waveguide which is different from the transmission line composed of multiple conductors represented by the microstrip line through which Transverse Electric Magnetic Waves (TEM waves) propagate and used as the host line, originally includes inductance components in the shunt part. Therefore, in a frequency equal to or lower than a specific frequency, the electromagnetic waves do not propagate through the waveguide. This predetermined frequency is called a cutoff frequency. This cutoff frequency is generated due to the inductance components of the shunt part of the waveguide. Since the waveguide originally includes the inductance components in the shunt part, the waveguide serves as the composite right/left-handed transmission line by introducing only the capacitance into the series part. In the present invention, the capacitance in the series part is obtained by providing a slit or the opening part in the waveguide.

Further, under a condition in which the phase velocity of the electromagnetic waves in the transmission line is higher than the phase velocity of the electromagnetic waves propagating through the air, the phase of the electromagnetic waves propagating through the transmission line matches the phase of the electromagnetic waves that may propagate through the air and the electromagnetic waves propagating through the transmission line are efficiently radiated (leaked out) into the air. This frequency band is particularly called a fast wave region. In the right/left-handed transmission line formed of the waveguide and the slit, the fast wave region is at around the zero-order resonance frequency (in the vicinity of the frequency where the phase velocity becomes zero), for example, whereby it is possible to efficiently radiate the electromagnetic waves into space.

Further, in the leaky wave antenna of the composite right/left-handed transmission line formed of the waveguide with the slits, the electromagnetic waves propagating through the waveguide can leak into the external space only from the slit. Therefore, by making the shape of the slits in the waveguide different from one another in a unit of the unit structure that forms the leaky wave antenna, it becomes possible to control the radio wave radiation efficiency per antenna length.

First Exemplary Embodiment

Next, with reference to the drawings, a first exemplary embodiment of an antenna apparatus according to the present invention will be described in detail.

(Structure of Antenna Apparatus According to First Exemplary Embodiment)

First, a structure of the first exemplary embodiment of the antenna apparatus according to the present invention will be described with reference to FIGS. 1 to 3. FIG. 1 is a schematic view showing one example of a perspective view of the antenna apparatus according to the first exemplary embodiment of the present invention, FIG. 2 is a schematic view showing one example of a plan view of the antenna apparatus shown in FIG. 1, and FIG. 3 is a schematic view showing one example of a cross-sectional view of the antenna apparatus shown in FIG. 1.

Figure 2:
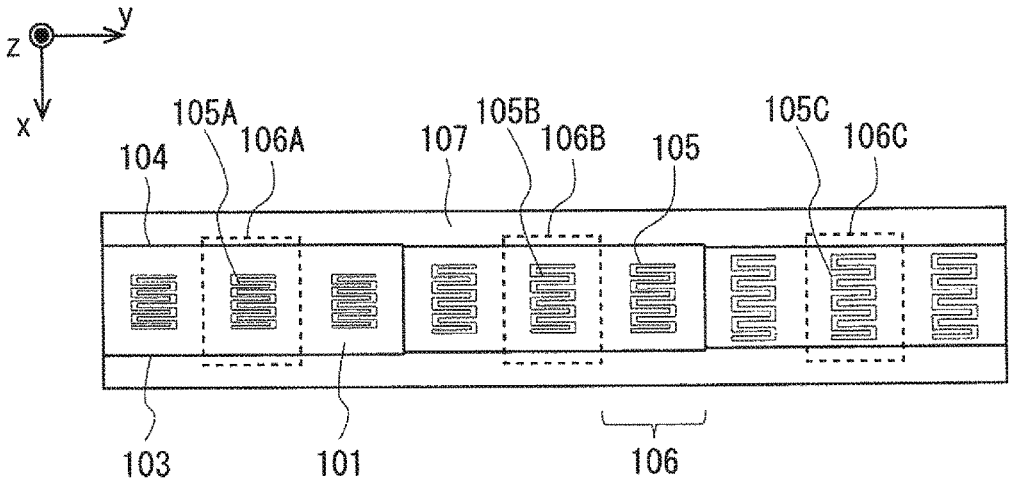
FIG. 2 is a schematic view showing one example of a plan view of the antenna apparatus shown in FIG. 1.
Figure 3:
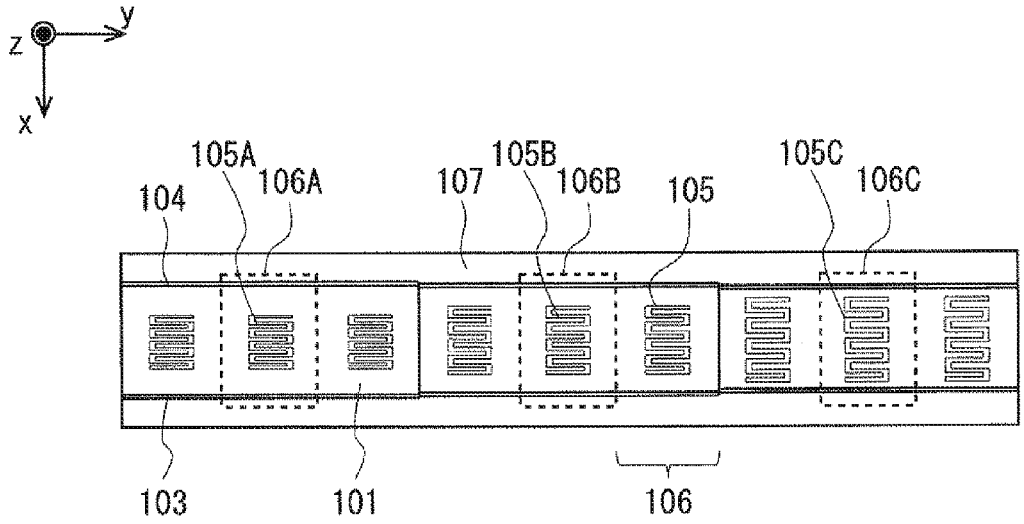
FIG. 3 is a schematic view showing one example of a cross-sectional view of the antenna apparatus shown in FIG. 1.

As shown in each of FIGS. 1 to 3, the antenna apparatus according to the first exemplary embodiment includes a plurality of unit structures 106, each including a first planar conductor 101, a second planar conductor 102, a first conductor connection part 103, a second conductor connection part 104, and an opening part 105, and the plurality of unit structures 106 are arranged in a direction (y-axis direction) perpendicular to a direction (x-axis direction), which is a direction of a line segment that connects the first conductor connection part 103 and the second conductor connection part 104 (FIGS. 1 to 3 show a case in which nine unit structures 106 are arranged). The antenna apparatus according to the present invention is thus formed.

The first planar conductor 101 and the second planar conductor 102 are arranged in layers different from each other and the first planar conductor 101 and the second planar conductor 102 are respectively arranged on a front-surface side and a rear-surface side so that the respective conductors are opposed to each other with a dielectric 107 interposed therebetween. When this antenna apparatus is formed using a technique such as a metal plate, the dielectric 107 may be air. When the antenna apparatus according to the first exemplary embodiment is observed in a z-axis direction, which is a direction vertical to the surface of the first planar conductor 101, that is, a direction vertical to the paper of FIG. 2, it is required that the first planar conductor 101 and the second planar conductor 102 at least partially overlap each other.

The first conductor connection part 103 electrically connects the first planar conductor 101 and the second planar conductor 102. The second conductor connection part 104 electrically connects the first planar conductor 101 and the second planar conductor 102 in a position different from the position of the first conductor connection part 103. In the examples shown in FIGS. 1 to 3, the first conductor connection part 103 is arranged in the vicinity of the lower side of the unit structure 106 and the second conductor connection part 104 is arranged in the vicinity of the upper side of the unit structure 106 so that the first conductor connection part 103 and the second conductor connection part 104 are opposed to each other, and the first planar conductor 101 and the second planar conductor 102 are electrically connected to each other. Further, in the examples shown in FIGS. 1 to 3, an example in which the first conductor connection part 103 and the second conductor connection part 104 are formed of plate-like conductors is shown.

Figure 4:
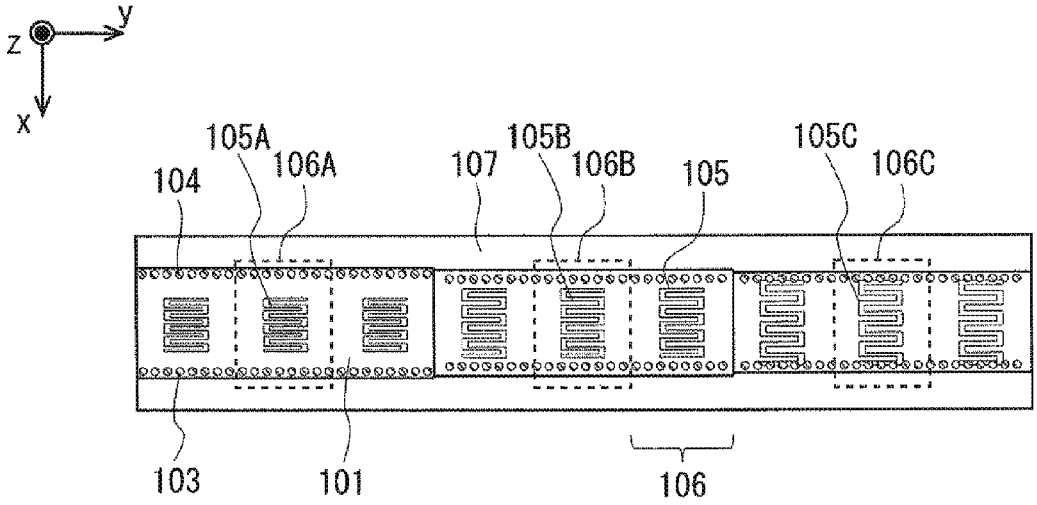
FIG. 4 is a schematic view showing one example of a cross-sectional view in a case in which a first conductor connection part and a second conductor connection part of the antenna apparatus shown in FIG. 1 are formed of conductive post arrays.

The cross-sectional view of the antenna apparatus shown in FIG. 3 is a view showing the xy cross section between the first planar conductor 101 and the second planar conductor 102 (cross-sectional view when the rear-surface side of the first planar conductor 101 is seen in the vertical direction, that is, in the z-axis direction) and shows a state in which both the first conductor connection part 103 and the second conductor connection part 104 are formed of the plate-like conductors, as stated above. However, when the antenna apparatus according to the present invention is formed using a dielectric substrate such as the dielectric 107, as shown in FIG. 4, for example, the first conductor connection part 103 and the second conductor connection part 104 may be formed using conductive post arrays. FIG. 4 is a schematic view showing one example of a cross-sectional view in a case in which the first conductor connection part 103 and the second conductor connection part 104 of the antenna apparatus shown in FIG. 1 are formed of the conductive post arrays and shows one example of a case in which the rear-surface side of the first planar conductor 101 is observed from a position on the xy cross section between the first planar conductor 101 and the second planar conductor 102. While a case in which both the first conductor connection part 103 and the second conductor connection part 104 are formed of conductive post arrays is shown in FIG. 4, only one of them may be formed of the conductive post array.

The opening part 105 is arranged in an area held between the first conductor connection part 103 and the second conductor connection part 104 on the first planar conductor 101. While an example in which the opening part 105 is formed in a meandering shape (that is, a zigzag shape) is shown in the examples shown in FIGS. 1 to 4, the opening part 105 may have any other shape as long as it is possible to obtain a capacitance value that is necessary to operate the antenna apparatus according to the present invention at a desired frequency.

The unit structure 106, which is a basic constituent unit as a constituent element of the antenna apparatus, at least includes, as stated above, the first planar conductor 101, the second planar conductor 102, the first conductor connection part 103, the second conductor connection part 104, and the opening part 105. In the antenna apparatus according to the first exemplary embodiment, as shown in FIGS. 1 to 4, the plurality of unit structures 106 are formed in a direction (y-axis direction in FIGS. 1 to 4) perpendicular to the direction of the line segment that connects the first conductor connection part 103 and the second conductor connection part 104 (x-axis direction in FIGS. 1 to 4) so that each of the first planar conductor 103 and the second planar conductor 104 forms one plane. There are a plurality of types (three types in this exemplary embodiment) of unit structures 106 including the opening parts 105 having shapes different from one another. That there are a plurality of types of unit structures 106 including the opening parts 105 having shapes different from one another is one of the characteristics of the antenna apparatus according to the first exemplary embodiment. In the antenna apparatus according to this exemplary embodiment, there are three types of unit structures 106: a unit structure 106A, a unit structure 106B, and a unit structure 106C. The opening parts 105 of the unit structures 106A, 106B, and 106C are opening parts 105A, 105B, and 105C, respectively, and have shapes different from one another. Because of the difference in the shapes of the opening parts 105 of the unit structures 106, the radiation efficiency per antenna length is controlled.

(Basic Operation Principles of Structure of Antenna Apparatus According to First Exemplary Embodiment and Effects Thereof)

Figure 5:
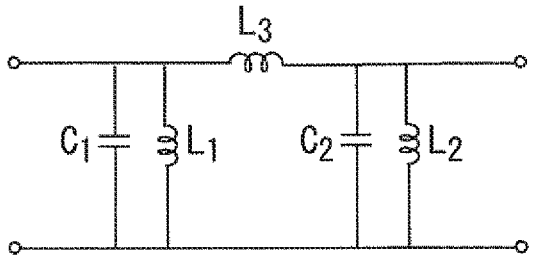
FIG. 5 is a circuit diagram showing an equivalent circuit of a waveguide formed of a first planar conductor, a second planar conductor, a first conductor connection part, and a second conductor connection part in the antenna apparatus according to the first exemplary embodiment shown in FIGS. 1 to 4.

Next, basic operation principles of the antenna apparatus according to the first exemplary embodiment shown in FIGS. 1 to 4 will be described. In the antenna apparatus according to the first exemplary embodiment shown in FIGS. 1 to 4, a waveguide is formed of the first planar conductor 101, the second planar conductor 102, the first conductor connection part 103, and the second conductor connection part 104. The waveguide can be described by an equivalent circuit shown in FIG. 5. FIG. 5 is a circuit diagram showing an equivalent circuit when the opening part 105 is removed from the waveguide formed of the first planar conductor 101, the second planar conductor 102, the first conductor connection part 103, and the second conductor connection part 104 in the antenna apparatus according to the first exemplary embodiment shown in FIGS. 1 to 4.

In a transmission line formed of normal multiple conductors different from the waveguide, the equivalent circuit per unit length is typically described using only an inductance of a series part and a capacitance of a shunt part. On the other hand, in the waveguide, as shown in FIG. 5, the equivalent circuit per unit length is described so that inductances $L_1$ and $L_2$ are further included in the shunt part in addition to an inductance $L_3$ of the series part and capacitances $C_1$ and $C_2$ of the shunt part.

Figure 6:
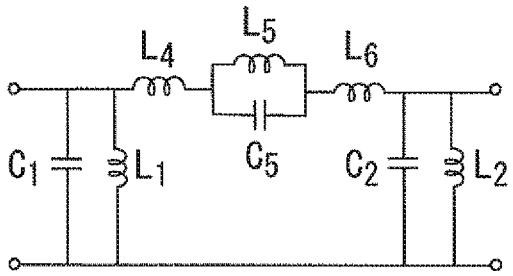
FIG. 6 is a circuit diagram showing one example of an equivalent circuit when a unit structure, which is a constituent unit of the antenna apparatus according to the first exemplary embodiment shown in FIGS. 1 to 4, has an opening part.

Further, in the unit structure 106, which is the constituent element of the antenna apparatus according to the first exemplary embodiment, the opening part 105 is formed in the conductor that forms the waveguide (i.e., first planar conductor 101) and the capacitance components are introduced into the series part of the waveguide. Therefore, the unit structure 106 of the antenna apparatus according to the first exemplary embodiment is described by an equivalent circuit that may operate as the composite right/left-handed transmission line as shown in FIG. 6. FIG. 6 is a circuit diagram showing one example of the equivalent circuit when the unit structure 106, which is the constituent unit of the antenna apparatus according to the first exemplary embodiment shown in FIGS. 1 to 4, includes the opening part 105 and the series part is described to include, besides an inductance $L_4$ and an inductance $L_6$, a parallel resonance circuit of an inductance $L_5$ and a capacitance $C_5$, unlike in the case shown in FIG. 5. While the inductances or the capacitances shown by the symbols the same as those in FIG. 5 are shown in FIG. 6, the values of the inductances and the capacitances of the circuit elements shown in FIG. 6 and the values of the inductances and the capacitances of the circuit elements shown in FIG. 5 may not necessarily be the same values. For example, the inductance $L_1$ shown in FIG. 6 and the inductance $L_1$ shown in FIG. 5 may not necessarily be the same value.

Figure 7:
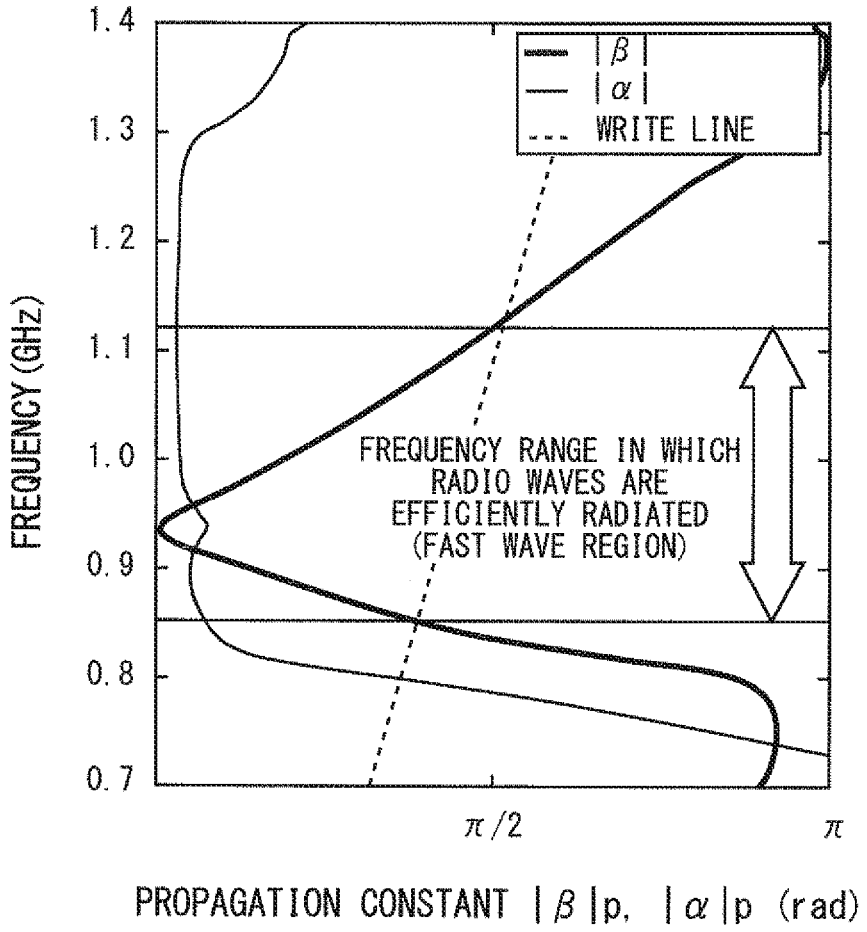
FIG. 7 is a diagram for describing one example of operation principles of the antenna apparatus according to the first exemplary embodiment shown in FIGS. 1 to 4.

FIG. 7 is a diagram for describing one example of operation principles of the antenna apparatus according to the first exemplary embodiment shown in FIGS. 1 to 4 and shows one example of a dispersion relation when an infinite number of unit structures 106, the unit structure 106 being the constituent element of the antenna apparatus according to the first exemplary embodiment, are arranged. The dispersion relation shown in FIG. 7 is obtained by analyzing the unit structures 106 by the finite element method and imposing Bloch periodic boundary conditions on an S parameter that has been calculated.

It will be understood from FIG. 7 that the antenna apparatus behaves as a left-handed transmission line in a frequency band of about 800 MHz to 930 MHz and behaves as a right-handed transmission line in a frequency band of about 950 MHz to 1350 MHz. That is, the antenna apparatus behaves as a composite right/left-handed transmission line. A frequency range in which a propagation constant β shown by the thick line in FIG. 7 is in the upper left side with respect to a write line shown by the dotted line is a range in which the phase of electromagnetic waves propagating through the line matches the phase of electromagnetic waves that can exist in the air, which means it corresponds to the frequency range in which the electromagnetic waves can leak into the air. Therefore, in the frequency range shown by the double-headed arrow in FIG. 7, the antenna apparatus can serve as the antenna in which the radio wave radiation efficiency is high.

As described above, the antenna apparatus according to the first exemplary embodiment is formed by coupling at least two types of unit structures including the opening parts 105 having shapes different from each other. In the leaky wave antenna composed of the composite right/left-handed transmission line composed of the waveguide formed of the first planar conductor 101, the second planar conductor 102, the first conductor connection part 103, and the second conductor connection part 104 and the slit (opening part 105), the parts other than the slit are surrounded by conductors. Therefore, the only part from which the electromagnetic waves propagating through the waveguide can leak into an external space is the slit of the opening part 105. Therefore, by providing the slits or the opening parts 105 having at least two or more different shapes as the slit or the opening part 105 for each unit structure 106 provided in the waveguide, it becomes possible to control the radio wave radiation efficiency per antenna length.

Next, the principle by which the control of the radio wave radiation amount per antenna length can be achieved will be described in further detail taking a case in which the shape of the opening part 105 in the antenna apparatus according to the first exemplary embodiment is a meandering shape as shown in FIGS. 1 to 4 as an example. The antenna apparatus shown in FIGS. 1 to 4 as an example of the first exemplary embodiment includes the unit structure 106A, the unit structure 106B, and the unit structure 106C respectively having the opening part 105A, the opening part 105B, and the opening part 105C whose shapes are different from one another. In the following description, with reference to a schematic view in FIG. 8, it will be explained that it is possible to control the radiation efficiency per antenna length by taking one of the unit structure 106A, the unit structure 106B, and the unit structure 106C, which are three types of unit structures of the constituent element that forms the antenna apparatus, as one example.

Figure 8:
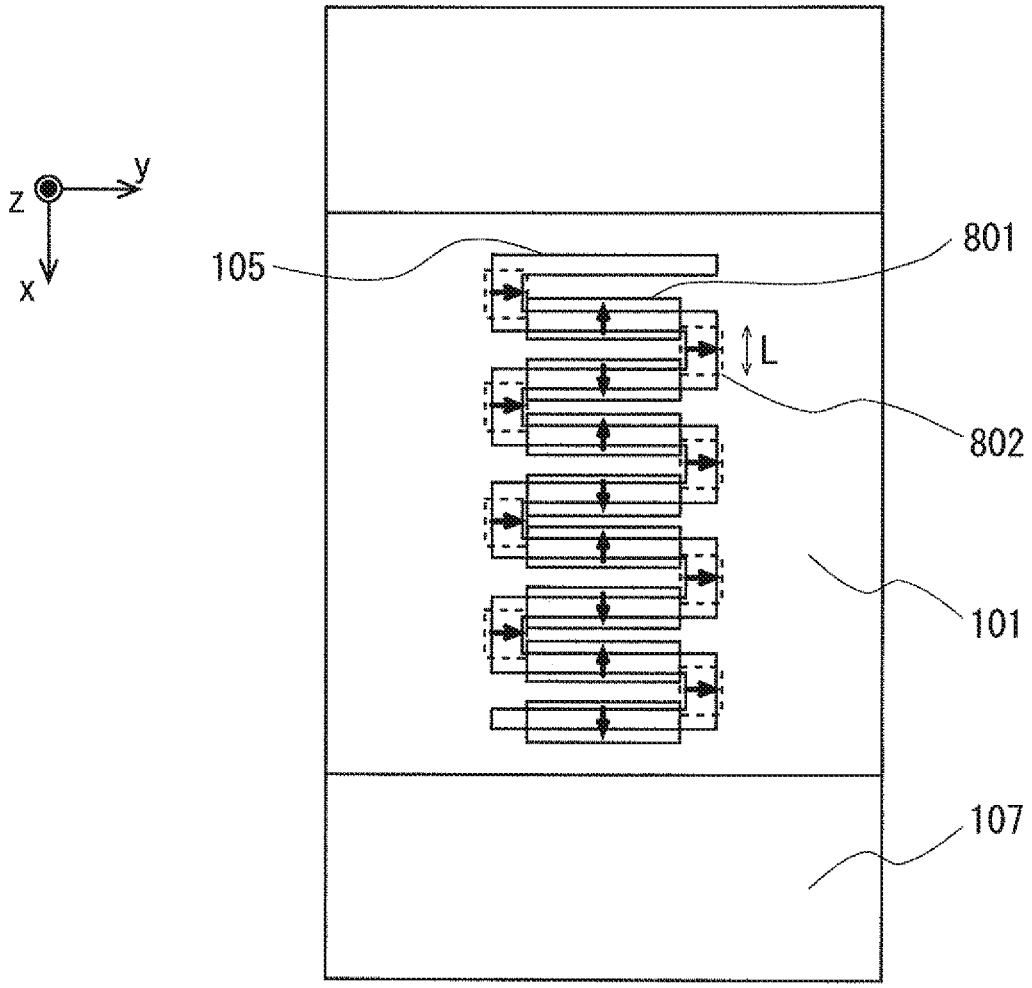
FIG. 8 is a schematic view for describing one example of the operation principles of the antenna apparatus according to the first exemplary embodiment.

FIG. 8 is a schematic view for describing the operation principles of the antenna apparatus according to the first exemplary embodiment and shows a state of the electric field of a specific phase in the opening part 105 (one of the opening part 105A, the opening part 105B, and the opening part 105C) in the unit structure 106 (one of the unit structure 106A, the unit structure 106B, and the unit structure 106C). Needless to say, an electric field the same as the one shown in FIG. 8 is also formed in the two other types of the opening parts 105.

The slit (opening part 105) having a meandering shape shown in FIGS. 1 to 4 as the shape of the opening part 105 can be roughly separated into line elements that contribute to the radiation of the electromagnetic waves (i.e., line elements that do not include opposing parts) and line elements that do not contribute to the radiation of the electromagnetic waves (i.e., line elements having opposing parts where the directions of the electric fields become opposite to each other). In an opening 801 formed of the line elements in which electric fields in the x-axis direction shown as vertical arrows in FIG. 8 are generated, there are line elements that are opposed to each other and the directions of the electric fields of the opening 801 formed of the line elements adjacent to each other become opposite to each other. Therefore, the electromagnetic waves that leak into the space from the openings 801 interfere with each other and then cancel each other, which means that the openings 801 do not effectively contribute to the radiation of the electromagnetic waves. On the other hand, regarding the electromagnetic waves that leak from an opening 802 formed of the line elements in which electric fields in the y-axis direction shown as horizontal arrows in FIG. 8 are generated, there are no line elements that are opposed to each other. Therefore, the directions of the electric fields are the same in all of the openings 802, and the electromagnetic waves do not interfere with each other and thus do not cancel each other.

Therefore, in the slit (opening part 105) having a meandering shape, the radiation efficiency of the electromagnetic waves can be adjusted by adjusting a length L of the opening 802. In reality, however, when the length L of the opening 802 is changed in order to suppress a change in the frequency of the Bloch impedance and the dispersion relation of the composite right/left-handed transmission line, other parameters (e.g., the length of the opening 801, the waveguide width (distance between the first conductor connection part 103 and the second conductor connection part 104), or the length of the unit structure) need to be adjusted together with the shape of the opening part 105.

Figure 9:
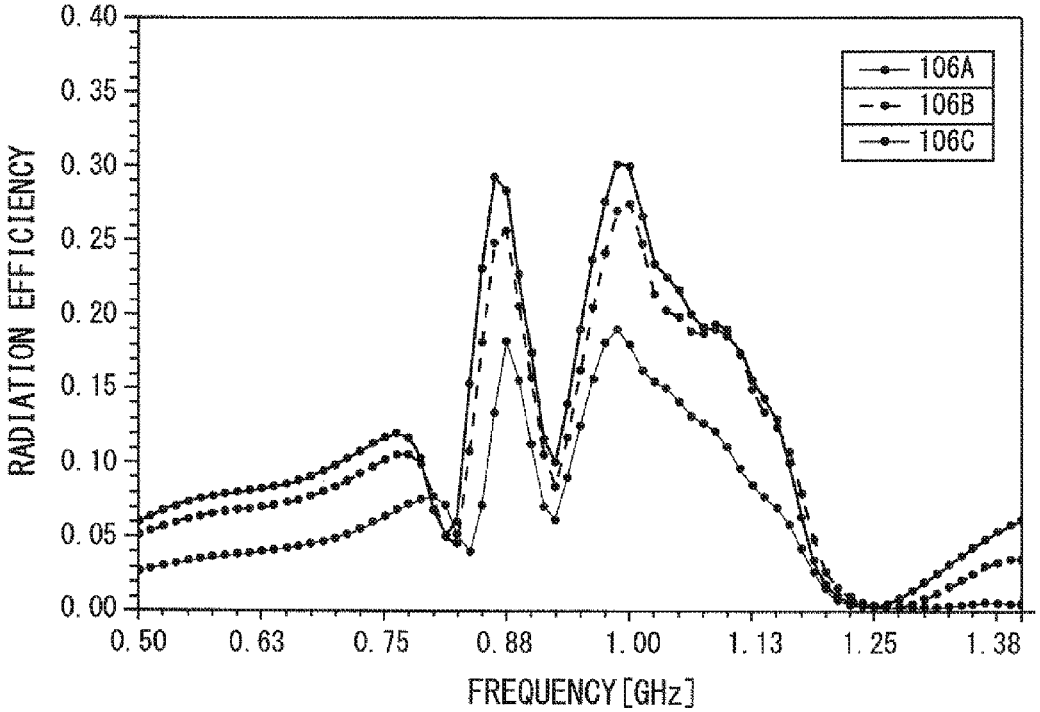
FIG. 9 is a graph showing one example of a result of an analysis of a radiation efficiency of electromagnetic waves of the antenna apparatus according to the first exemplary embodiment.

FIG. 9 is a graph showing one example of the result of the analysis of the radiation efficiency of the electromagnetic waves of the antenna apparatus according to the first exemplary embodiment and shows a graph of the radiation efficiency of the leaky wave antenna in the antenna apparatus when seven unit structures 106 including the opening parts 105 of the same shape are arranged.

In FIG. 9, three types of leaky wave antennas formed of the unit structures 106 including the opening parts 105 whose lengths of the openings 802 (lengths L of the openings 802 in FIG. 8) are different from one another are compared. In FIG. 9, the radiation efficiencies of the antenna apparatus in which the lengths L of the openings 802 are 1.8 mm, 3.6 mm, and 4.5 mm are calculated in the case in which the seven unit structures 10 have the opening parts 105 having the same shape. The radiation efficiencies of the antenna apparatus when the lengths L of the openings 802 are 1.8 mm, 3.6 mm, and 4.5 mm are respectively shown by line graphs of the thin solid line, the broken line, and the thick solid line. That is, among the three types of unit structures 106, the radio efficiency of the electromagnetic waves when seven unit structures 106A including the opening parts 105A whose length L of the opening 802 is 1.8 mm are arranged is shown by the line graph of the thin solid line, the radio efficiency of the electromagnetic waves when seven unit structures 106B including the opening parts 105B whose length L of the opening 802 is 3.6 mm are arranged is shown by the line graph of the thin solid line, and the radio efficiency of the electromagnetic waves when seven unit structures 106C including the opening parts 105C whose length L of the opening 802 is 4.5 mm are arranged is shown by the line graph of the thin solid line.

Figure 11:
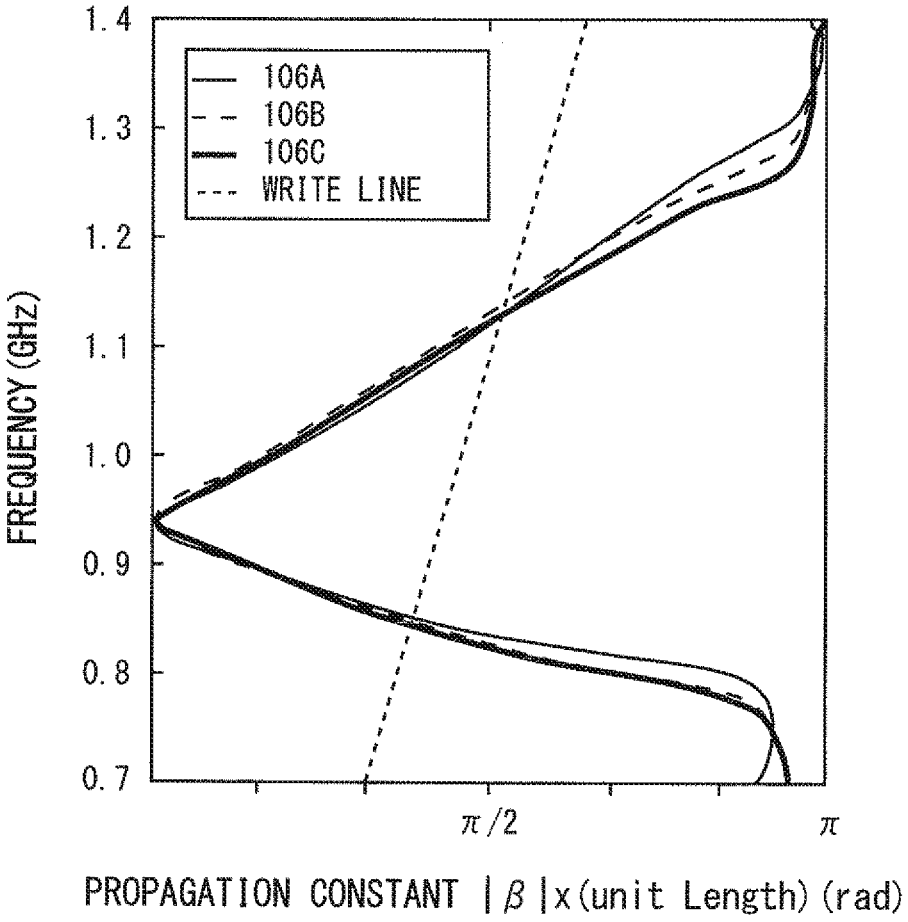
FIG. 11 is a diagram for further describing one example of operation principles of the antenna apparatus according to the first exemplary embodiment.

FIG. 11 is a diagram for further describing one example of the operation principles of the antenna apparatus according to the first exemplary embodiment, and shows a dispersion relation when an infinite number of unit structures 106A including the opening parts 105A, unit structures 106B including the opening parts 105B, and unit structures 106C including the opening parts 105C, the opening parts 105A to 105C being different from one another, are each periodically arranged, similar to the case shown in FIG. 7. The dispersion relation shown in FIG. 11 is obtained by analyzing each of the unit structure 106A, the unit structure 106B, and the unit structure 106C by the finite element method using the analysis method similar to that of FIG. 7 and imposing the Bloch periodic boundary conditions on the S parameter that has been calculated.

It will be understood from FIG. 11 that in any one of the three types of unit structures 106A, unit structures 106B, and unit structures 106C, the antenna apparatus serves as the composite right/left-handed transmission line whose characteristic is switched from the left-handed transmission line to the right-handed transmission line at around 930 MHz. Similar to the case shown in FIG. 7, a frequency range in which a propagation constant β is in the upper left side with respect to the write line shown by the dotted line in FIG. 11 is a range in which the phase of the electromagnetic waves propagating through the line matches the phase of the electromagnetic waves that can exist in the air, which means it corresponds to the frequency range in which the electromagnetic waves can leak into the air.

That is, as shown in the dispersion curve in FIG. 11, it will be understood that the dispersion relation of the electromagnetic waves propagating through the composite right/left-handed transmission line does not greatly vary among the composite right/left-handed transmission lines in which an infinite number of unit structures 106A including the opening parts 105A, unit structures 106B including the opening parts 105B, and unit structures 106C including the opening parts 105C, the opening parts 105A to 105C being different from one another, are each periodically arranged.

As shown in FIG. 9, in the slit (opening part 105) having a meandering shape, the radiation efficiency of the electromagnetic waves can be improved as the length L of the opening 802 is made larger. It will therefore be understood that it is possible to adjust the radiation efficiency of the electromagnetic waves by adjusting the length L of the opening 802.

Figure 10:
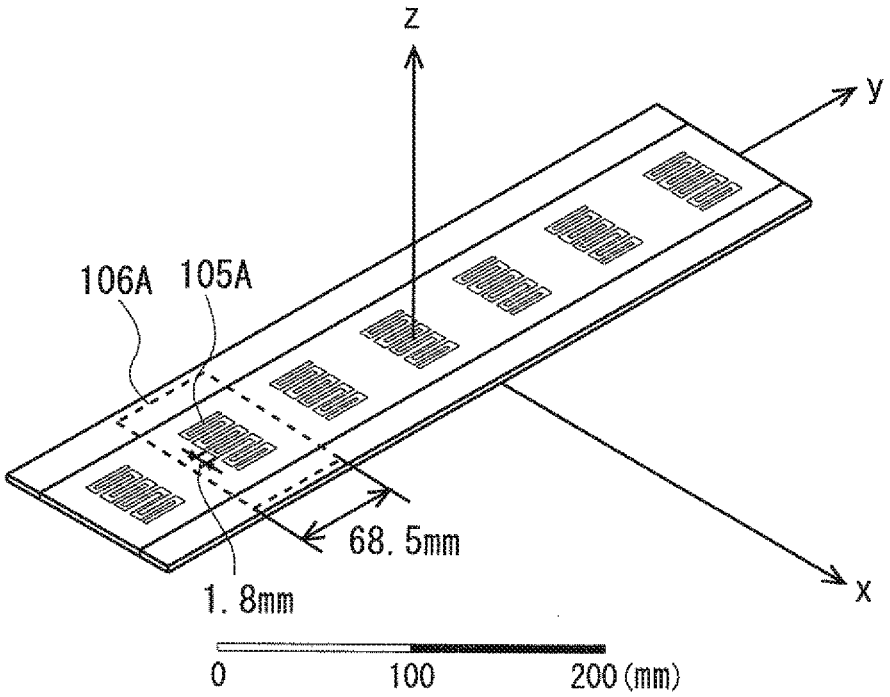
FIG. 10 is a schematic view showing one example of an electromagnetic field analysis model for performing an analysis of the radiation efficiency of the electromagnetic waves of the antenna apparatus according to the first exemplary embodiment.

FIG. 10 is a schematic view showing one example of an electromagnetic field analysis model for analyzing the radiation efficiency of the electromagnetic waves of the antenna apparatus according to the first exemplary embodiment and shows an example of the electromagnetic field analysis model of the leaky wave antenna when seven unit structures 106A including the opening parts 105A whose length L of the openings 802 is 1.8 mm are arranged. The length of the unit structures 106A in the direction in which the unit structures 106A are arranged is 68.5 mm. As described with reference to FIG. 9, the radiation efficiency of the electromagnetic waves is improved in the order of the unit structure 106A including the opening part 105A, the unit structure 106B including the opening part 105B, and the unit structure 106C including the opening part 105C as the length L of the opening 802 increases. It will therefore be understood that it is possible to control the radiation efficiency of the electromagnetic waves of the unit structure 106 by adjusting the length L of the opening 802 as described above.

Further, the length of the unit structures 106B in the direction in which the unit structures 106B are arranged and the length of the unit structures 106C in the direction in which the unit structures 106C are arranged used for the analysis of FIG. 9 are set to 68.5 mm, which is the same as that in the case in which the unit structures 106A are arranged as shown in FIG. 10. That is, as shown in the result of the analysis shown in FIG. 9, the length of the unit structures 106 in the direction in which the unit structures 106 are arranged is not used as the adjustment parameter for adjusting the radiation efficiency of the electromagnetic waves. In other words, by adjusting the length L of the opening 802, it is possible to control the radiation efficiency per length of the unit structures 106 in the direction in which the unit structures 106 are arranged (in this case, per length of 68.5 mm), that is, the radiation efficiency per antenna length. While the length of the unit structures 106 in the direction in which the unit structures 106 are arranged is not used as the adjustment parameter in this example for the sake of convenience of the description, it may be naturally used as the adjustment parameter.

Figure 12:
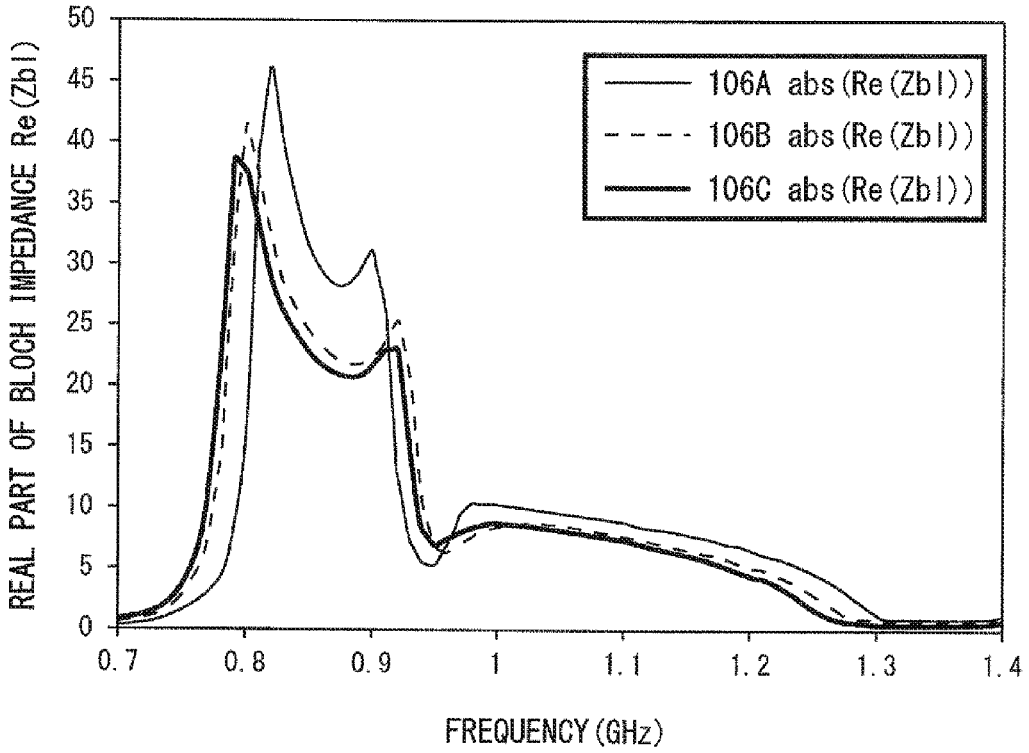
FIG. 12 is a diagram for further describing one example of the operation principles of the antenna apparatus according to the first exemplary embodiment from an aspect different from the aspect shown in FIG. 11.
Figure 13:
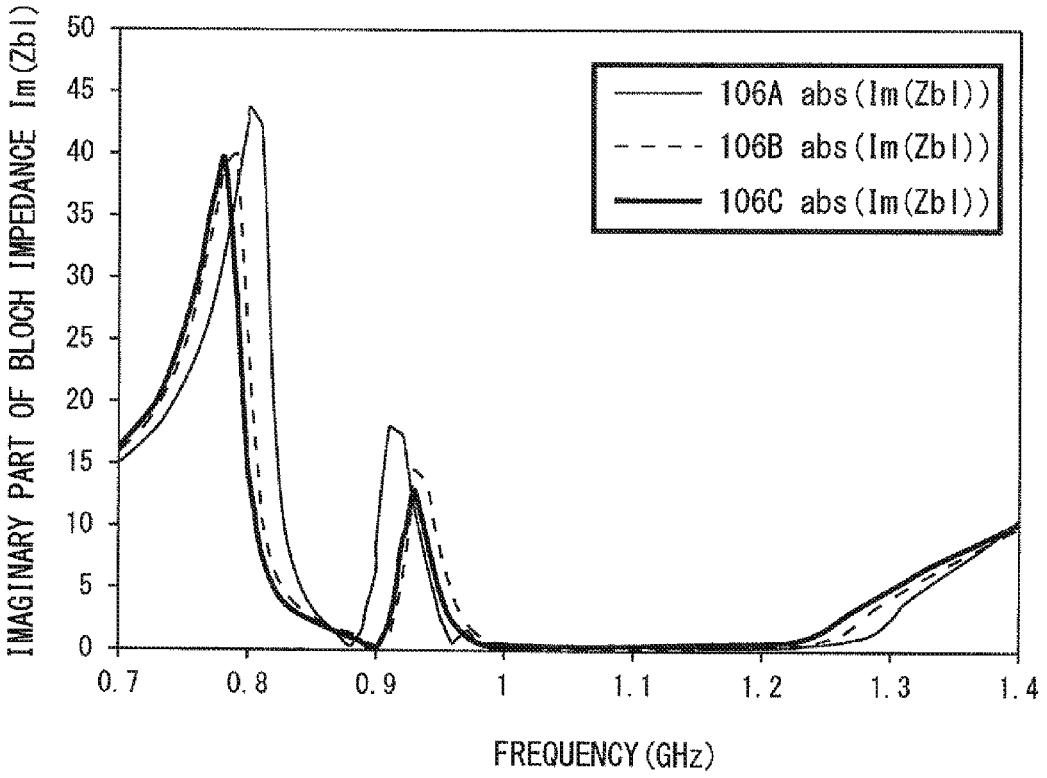
FIG. 13 is a diagram for further describing one example of the operation principles of the antenna apparatus according to the first exemplary embodiment from an aspect different from the aspect shown in FIG. 11.

FIGS. 12 and 13 are diagrams for further describing one example of the operation principles of the antenna apparatus according to the first exemplary embodiment from an aspect different from the one shown in FIG. 11. FIGS. 12 and 13 describe one example of the frequency characteristics regarding the absolute values of the real part and the imaginary part of the Bloch impedance when an infinite number of unit structures 106A including the opening parts 105A, unit structures 106B including the opening parts 105B, and unit structures 106C including the opening parts 105C that are each periodically arranged, the opening parts 105A to 105C being different from one another, are seen from the end surface of the unit structures 106.

As shown in FIGS. 12 and 13, the frequency characteristics of the Bloch impedance in the three types of composite right/left-handed transmission lines having a structure in which the infinite number of unit structures 106A including the opening parts 105A, unit structures 106B including the opening parts 105B, and unit structures 106C including the opening parts 105C, the opening parts 105A to 105C being different from one another, are each periodically arranged does not greatly vary in either case.

That is, as shown in FIGS. 11, 12, and 13, the dispersion relation and the Bloch impedance that determine the characteristic of the composite right/left-handed transmission line do not greatly vary among the unit structures 106A including the opening parts 105A, the unit structures 106B including the opening parts 105B, and the unit structures 106C including the opening parts 105C, the lengths L of the openings 802 being different from one another. Therefore, even when one leaky wave antenna is formed of the three types of unit structures 106A, unit structures 106B, and unit structures 106C mixed with each other, the composite right/left-handed transmission line operates in a way substantially similar to the way in which the composite right/left-handed transmission line composed of a single type of unit structures operates.

Further, also from the result of the analysis of the radiation efficiency of the electromagnetic waves in FIG. 9, by forming the leaky wave antenna in which the unit structures 106A including the opening parts 105A, the unit structures 106B including the opening parts 105B, and the unit structures 106C including the opening parts 105C, the lengths L of the openings 802 being different from one another, are mixedly arranged, it is possible to obtain the leaky wave antenna in which the radiation efficiency per length of the unit structures 106 in the direction in which the unit structures 106 are arranged is controlled.

In the antenna apparatus according to the first exemplary embodiment described above, the case in which the opening part 105 has a meandering shape and is formed by combining rectangles folded in a zig-zag shape has been described. Needless to say, however, even when the opening part 105 has a more complicated meandering shape, by adjusting the length of the opening capable of radiating radio waves without being affected by the interference between the line elements for each unit structure 106, it is possible to obtain an antenna apparatus in which the radiation amount of the electromagnetic waves per length of the unit structures 106 in the direction in which the unit structures 106 are arranged, that is, the radiation amount per antenna length, is controlled, based on the exactly the same principle as that in the case when the opening part 105 as that in the case in which the opening part 105 has a meandering shape and is formed by combining rectangles folded in a zig-zag shape. The adjustment parameter when the opening part 105 having such a complicated shape is the length of the opening that does not radiate electric waves due to the interference and the waveguide width (distance between the first conductor connection part 103 and the second conductor connection part 104) or the length of the unit structures 106 in the direction in which the unit structures 106 are arranged can be easily assumed.

(First Modified Example of First Exemplary Embodiment)

Next, a first modified example according to the first exemplary embodiment will be described. In this first modified example, the opening part 105 has a linear shape, different from the one described above which is formed in a meandering shape. Further, an example in which the opening part 105 having the linear shape is formed in the direction that is perpendicular to the direction in which the unit structures 106 are arranged, that is, in the x-axis direction that is perpendicular to the y-axis direction, is shown. In this first modified example, the opening part 105 having the linear shape may not be formed in the direction that is perpendicular to the direction in which the unit structures 106 are arranged and the opening part 105 having the linear shape may be tilted by a predetermined angle from the direction in which the unit structures 106 are arranged. When the antenna apparatus is formed of the unit structures 106 including the opening parts 105 having the linear shape, the antenna apparatus according to the first exemplary embodiment is formed by mixedly arranging at least two or more types of unit structures 106 including the opening parts 105 having lengths different from one another.

When the opening part 105 has a linear shape, different from the case in which the opening part 105 has a meandering shape described above, there is no part in which radiation of electromagnetic waves disappear due to the mutual interference. Therefore, it is possible to control the radiation efficiency per antenna length by simply adjusting the length of the opening part 105. However, a simple change in the length of the opening part 105 causes significant changes in the dispersion relation of the composite right/left-handed transmission line and the frequency characteristic of the Bloch impedance.

In the example in which the opening part 105 has a meandering shape described above as the operation principles, the case in which the radiation efficiency per antenna length is controlled while keeping the dispersion relation and the Bloch impedance, which may be changed according to the change in the length of the opening 802, to be substantially the same without greatly changing them by adjusting the length of the opening 801 or the waveguide width (the distance between the first conductor connection part 103 and the second conductor connection part 104) has been shown. However, when the opening part 105 has a linear shape, as a result of the mutual interference of the opening part 105, the part corresponding to the opening 801 in the case of FIG. 8 that does not contribute to the radiation of the electromagnetic waves, that is, the part used as the adjustment parameter of the dispersion relation or the Bloch impedance, does not exist in the opening part 105. It is therefore required to introduce a new adjustment parameter.

Figure 14:
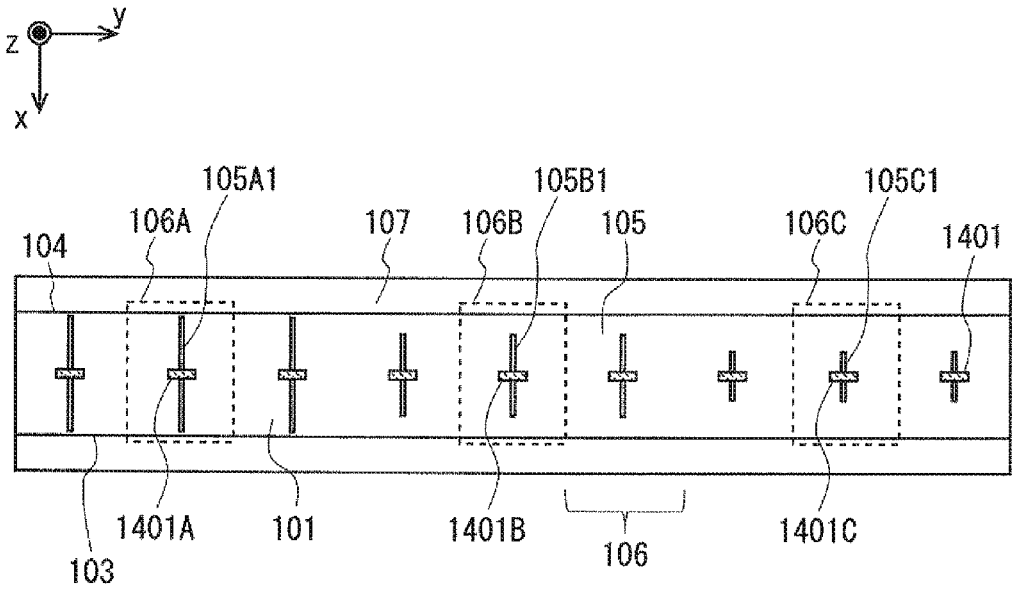
FIG. 14 is a schematic view for describing one example of a structure of the antenna apparatus according to the first exemplary embodiment different from that shown in FIG. 1.

FIG. 14 is a schematic view for describing one example of a structure different from that of the antenna apparatus according to the first exemplary embodiment shown in FIG. 1 and shows an example in which a chip capacitance 1401 is used as the adjustment parameter when the unit structure 106 including the opening part 105 having the linear shape is used.

Further, the example shown in FIG. 14 shows a case of the antenna apparatus in which nine unit structures 106, each including the opening part 105 having the linear shape, are arranged in the y-axis direction, and unit structures 106A1 including opening parts 105A1 whose length of the opening parts 105 is the longest, unit structures 106B1 including opening parts 105B1 whose length of the opening parts 105 is the second longest, and unit structures 106C1 including opening parts 105C1 whose length of the opening parts 105 is the shortest are arranged in order along the y-axis direction in such a way that the lengths of the opening parts 105 become gradually shorter for each of three successive unit structures 106.

Further, in the example shown in FIG. 14, in order to compensate for the frequency change of the radio wave radiation characteristic of the unit structure 106 due to a change in the length of the opening part 105, for each of the unit structures 106, a chip capacitance 1401 is attached to the vicinity of the center of the opening part 105 so that the chip capacitance 1401 spans the opening part 105. In this case, for the purpose of compensating for a reduction in capacitance values, which is due to the length of the opening parts 105 becoming shorter for each of the three unit structures 106 in the order of the opening parts 105A1, the opening parts 105B1, and the opening parts 105C1, chip capacitances 1401A whose capacitance value is the smallest are attached to the opening parts 105A1, chip capacitances 1401B whose capacitance value is the second smallest are attached to the opening parts 105B1, and chip capacitances 1401C whose capacitance value is the largest are attached to the opening parts 105C1 so that the capacitance values of the chip capacitances 1401 become gradually large.

As shown in FIG. 14, when the opening part 105 has a linear shape, it becomes possible to control the radiation efficiency while keeping the dispersion relation and the Bloch impedance, which may be changed according to the change in the length of the opening part 105, to be substantially the same without greatly changing them by adjusting the value of the chip capacitance 1401 and the waveguide width (the distance between the first conductor connection part 103 and the second conductor connection part 104).

Figure 15:
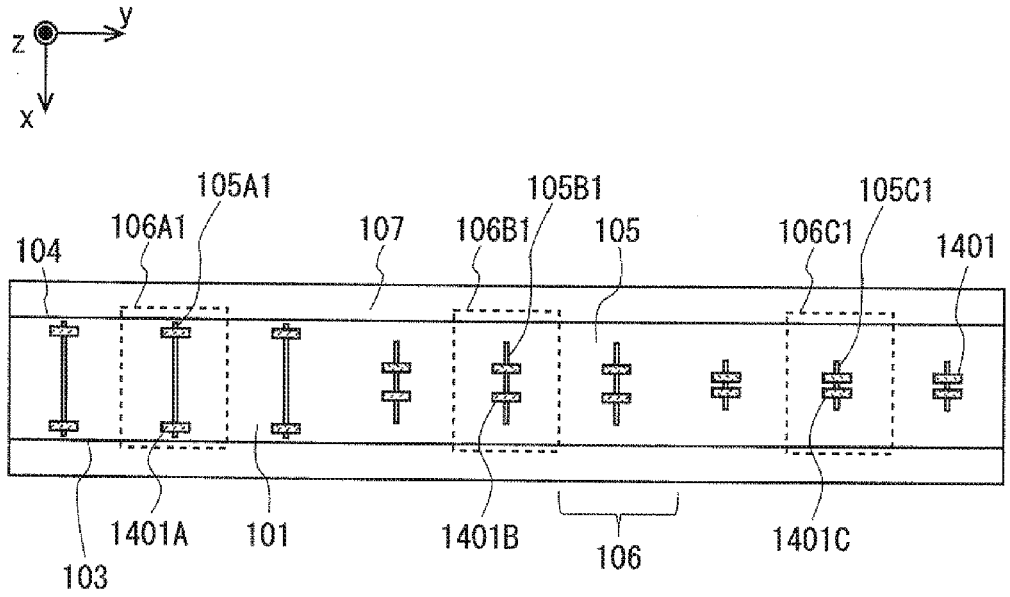
FIG. 15 is a schematic view for describing one example of a position where a chip capacitance is attached different from that shown in FIG. 14 in the antenna apparatus according to the first exemplary embodiment.

The example shown in FIG. 14 is a configuration example in which the chip capacitance 1401 is attached to the vicinity of the center of the opening part 105. However, the present invention is not limited to this case. For example, as shown in FIG. 15, it is also possible to compensate for the change in the characteristic of the unit structure 106 due to the change in the length of the opening part 105 by changing the position of the opening part 105 to which the chip capacitance 1401 is attached depending on the length of the opening part 105. FIG. 15 is a schematic view for describing one example of the case in which the frequency characteristic of the Bloch impedance and the dispersion relation are adjusted in the position of the opening part 105 where the chip capacitance 1401 is attached, different from the case shown in FIG. 14 in the antenna apparatus according to the first exemplary embodiment, and shows one example when the position of the opening part 105 where the chip capacitance 1401 is attached as the adjustment parameter in the case of the unit structure 106 including the opening part 105 having the linear shape is changed depending on the length of the opening part 105.

In the example shown in FIG. 15, unlike the case shown in FIG. 14, a pair of chip capacitances 1401 attached to each of the opening parts 105 are positioned symmetrically with respect to the central position of each of the opening parts 105. In this example, it is assumed that the chip capacitances 1401 have the same capacitance value regardless of the length of the opening part 105 to which the chip capacitance 1401 is attached.

The electric field excited in the opening part 105 becomes maximum in the vicinity of the center of the opening part 105 and becomes zero in the end parts of the opening part 105. That is, the chip capacitance 1401 attached to the vicinity of the center of the opening part 105 is strongly excited and effectively operates as if a large capacitance value was loaded. On the other hand, the chip capacitance 1401 attached to the vicinity of the end part of the opening part 105 is weakly excited and effectively operates as if a small capacitance value was loaded. That is, even when the chip capacitances 1401 have the same capacitance value, they operate as the chip capacitances whose effective capacitance values are different from one another depending on the positions to which they are attached.

Similar to the case shown in FIG. 14, the example shown in FIG. 15 shows a case of the antenna apparatus in which nine unit structures 106, each including the opening part 105 having the linear shape, are arranged in the y-axis direction, and unit structures 106A1 including opening parts 105A1 whose length of the opening parts 105 is the longest, unit structures 106B1 including opening parts 105B1 whose length of the opening parts 105 is the second longest, and unit structures 106C1 including opening parts 105C1 whose length of the opening parts 105 is the shortest are arranged in order along the y-axis direction in such a way that the lengths of the opening parts 105 become gradually shorter for each of three successive unit structures 106.

In the above case, in order to compensate for the reduction in the capacitance value of the unit structure 106, which is due to the length of the opening part 105 becoming shorter in the y-axis direction, it is required to further increase the capacitance value of the chip capacitance 1401. Therefore, in the example shown in FIG. 15, for the purpose of compensating for the reduction in the capacitance values, which is due to the length of the opening parts 105 becoming shorter for each of the three unit structures 106 in the order of the opening parts 105A1, the opening parts 105B1, and the opening parts 105C1, the positions of the opening parts 105 where the pair of chip capacitances 1401 are attached in such a way that the chip capacitances 1041 span the opening parts 105 are gradually changed from the end parts of the opening parts 105 to the center of the opening parts 105 as the lengths of the opening parts 105 become shorter so that the effective capacitance values of the chip capacitances 1401 become gradually larger.

That is, chip capacitances 1401A1 are attached to the vicinity of the end parts of the opening parts 105A1 in the unit structures 106A1 whose length of the opening parts 105 is the longest, chip capacitances 1401B1 are attached so that they become close to the center of the opening parts 105B1 in the unit structures 106B1 whose length of the opening parts 105 is the second longest, and chip capacitances 1401C1 are attached to the vicinity of the center of the opening parts 105C1 in the unit structures 106C1 whose length of the opening parts 105 is the shortest. Accordingly, even when the chip capacitances 1401 having the same capacitance value are used, by changing the position of the opening parts 105 to which the chip capacitances 1401 are attached depending on the length of the opening parts 105, it is possible to compensate for the changes in the capacitance values due to the change in the lengths of the opening parts 105.

The capacitance values of the chip capacitances 1401 to be attached to the respective opening parts 105 may not be the same and may be naturally different from one another as long as the characteristic may be desirably adjusted.

(Second Modified Example of First Exemplary Embodiment)

Next, a second modified example according to the first exemplary embodiment will be described. In the second modified example, when the shape of the opening parts 105 has a linear shape as shown in FIGS. 14 and 15, a case in which adjustable capacitance components are formed by attaching conductive patches to the opening parts 105 as the adjustment parameter instead of attaching the chip capacitances 1401 to the opening parts 105 will be described. In the second modified example, a case in which the opening parts 105 having the linear shape are formed in the direction that is perpendicular to the direction in which the unit structures 106 are arranged, that is, in the x-axis direction that is perpendicular to the y-axis direction, is described, similar to the cases shown in FIGS. 14 and 15 described in the first modified example. In the second modified example as well, the opening parts 105 having the linear shape may not be formed in the direction that is perpendicular to the direction in which the unit structures 106 are arranged and the opening parts 105 having the linear shape may be tilted by a predetermined angle from the direction in which the unit structures 106 are arranged.

Figure 16:
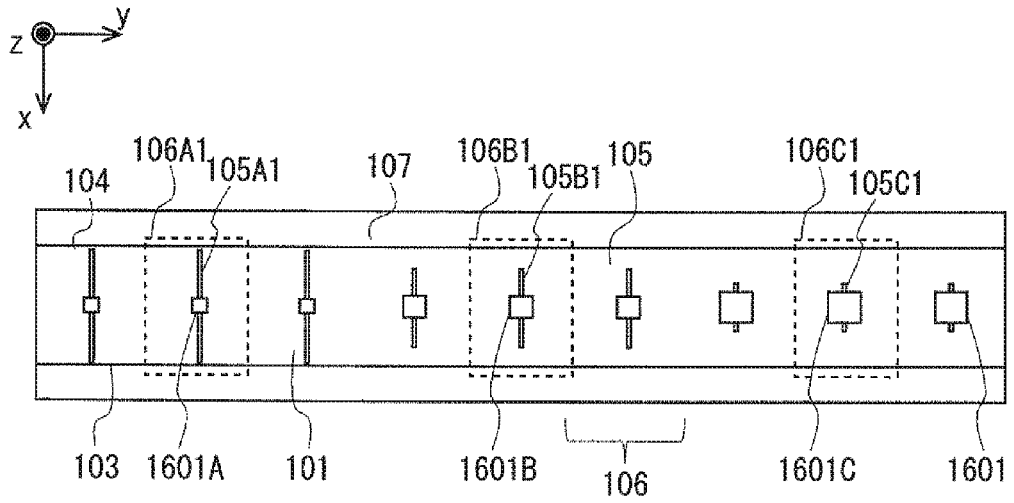
FIG. 16 is a schematic view for describing one example of a structure of the antenna apparatus according to the first exemplary embodiment different from the structures shown in FIGS. 1, 14, and 15.

FIG. 16 is a schematic view for describing one example of a structure of the antenna apparatus according to the first exemplary embodiment different from the structures shown in FIGS. 1, 14, and 15 and shows an example in which the capacitance components are formed by attaching conductive patches (e.g., island-shaped conductors 1601 having a rectangular plane shape) to the vicinity of the center of the opening parts 105 so that the conductive patches become opposed to the first planar conductor 101 in place of the chip capacitances 1401 as the adjustment parameter when the unit structures 106 including the opening parts 105 having the linear shape are used.

Further, the example shown in FIG. 16 shows, similar to the cases shown in FIGS. 14 and 15, a case of the antenna apparatus in which nine unit structures 106, each including the opening part 105 having the linear shape, are arranged in the y-axis direction, and unit structures 106A1 including opening parts 105A1 whose length of the opening parts 105 is the longest, unit structures 106B1 including opening parts 105B1 whose length of the opening parts 105 is the second longest, and unit structures 106C1 including opening parts 105C1 whose length of the opening parts 105 is the shortest are arranged in order along the y-axis direction in such a way that the lengths of the opening parts 105 become gradually shorter for each of three successive unit structures 106.

In the above case, in order to compensate for the reduction in the capacitance values of the unit structures 106, which is due to the length of the opening parts 105 becoming shorter in the y-axis direction, it is required to gradually increase the areas of the island-shaped conductors 1601 and to gradually increase the capacitance values formed between the island-shaped conductors 1601 and the first planar conductor 101. Therefore, in the example shown in FIG. 16, in order to compensate for the frequency change of the Bloch impedance and the dispersion relation, which is due to the change in the length of the opening part 105, the island-shaped conductor 1601 is attached to the vicinity of the center of the opening part 105 so that the island-shaped conductor 1601 spans the opening part 105 and is opposed to the first planar conductor 101 for each unit structure 106, whereby the capacitance components are formed. For the purpose of compensating for the reduction in capacitance values, which is due to the length of the opening parts 105 becoming shorter for each of the three unit structures 106 in the order of the opening part 105A1, the opening part 105B1, and the opening part 105C1, the areas of the island-shaped conductors 1601 arranged so that they span the opening parts 105 are gradually increased so that the capacitance components that are formed become gradually larger as the lengths of the opening parts 105 become shorter.

That is, island-shaped conductors 1601A having the smallest size are attached to the opening parts 105A1 of the unit structures 106A1 whose length of the opening parts 105 is the longest, island-shaped conductors 1601B having the second smallest size are attached to the opening parts 105B1 of the unit structures 106B1 whose length of the opening parts 105 is the second longest, and island-shaped conductors 1601C having the largest size are attached to the opening parts 105C1 of the unit structures 106C1 whose length of the opening parts 105 is the shortest. Therefore, by changing the area of the island-shaped conductor 1601 arranged in the opening part 105 depending on the length of the opening part 105, it is possible to compensate for the change in the capacitance values due to the change in the lengths of the opening part 105.

The island-shaped conductor 1601 arranged in the vicinity of the center of the opening part 105 so that it spans the opening part 105 may be arranged either on the upper-surface side of the first planar conductor 101 or on the lower-surface side thereof. Further, when the island-shaped conductor 1601 is used as well, the adjustment parameter based on the exactly the same principle as that of the case in which the position of the opening part 105 to which the chip capacitance 1401 is attached is changed according to the length of the opening part 105 in the first modified example of the first exemplary embodiment may be applied.

That is, the position where the island-shaped conductor 1601 is arranged is not limited to the vicinity of the center of the opening part 105 and the position on the opening part 105 to which the island-shaped conductor 1601 is attached may be adjusted depending on the length of the opening part 105, whereby it may be possible to compensate for the change in the characteristic of the unit structure 106 due to the change in the length of the opening part 105. Further, when the adjustment is performed by the position where the island-shaped conductor 1601 is arranged, similar to the case in the first modified example of the first exemplary embodiment, the area of the island-shaped conductor 1601 may vary depending on the length of the opening part 105 or may be fixed regardless of the length of the opening part 105.

Figure 17:
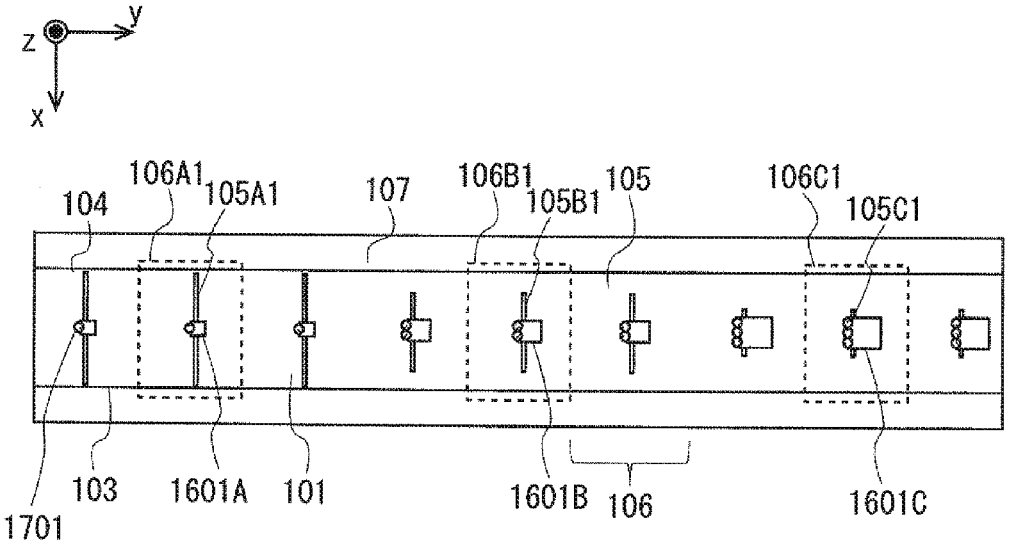
FIG. 17 is a schematic view for describing a configuration example when one end of an island-shaped conductor is electrically connected to a first planar conductor in the antenna apparatus according to the first exemplary embodiment.

While the configuration example in which the island-shaped conductor 1601, which is one example of the conductive patch, is arranged substantially at the center of the opening part 105 so as to span the opening part 105 as the adjustment parameter has been shown in the example shown in FIG. 16, the present invention is not limited to such a case. As shown in FIG. 17, for example, besides the island-shaped conductor 1601, which is the conductive path, a via that is electrically connected to the first planar conductor 101, that is, a third conductor connection part 1701, may be arranged in one end of the island-shaped conductor 1601 in the y-axis direction. FIG. 17 is a schematic view for describing a configuration example of a case in which one end of the island-shaped conductor 1601 is electrically connected to the first planar conductor 101 in the antenna apparatus according to the first exemplary embodiment and shows an example in which the third conductor connection part 1701 is further connected to one end of the island-shaped conductor 1601 in the y-axis direction attached as the adjustment parameter of the unit structure 106 including the opening part 105 having the linear shape and one end of the island-shaped conductor 1601 and the first planar conductor 101 are electrically connected to each other.

The example shown in FIG. 17 shows, similar to the case shown in FIG. 16, a case of the antenna apparatus in which nine unit structures 106, each including the opening part 105 having the linear shape, are arranged in the y-axis direction and unit structures 106A1 including opening parts 105A1 whose length of the opening parts 105 is the longest, unit structures 106B1 including opening parts 105B1 whose length of the opening parts 105 is the second longest, and unit structures 106C1 including opening parts 105C1 whose length of the opening parts 105 is the shortest are arranged in order along the y-axis direction in such a way that the lengths of the opening parts 105 become gradually shorter for each of three successive unit structures 106.

In the above case, in order to compensate for the frequency change of the Bloch impedance and the dispersion relation, which is due to the change in the length of the opening part 105, similar to the case shown in FIG. 16, the island-shaped conductor 1601 is attached to the vicinity of the center of the opening part 105 so that the island-shaped conductor 1601 spans the opening part 105 and is opposed to the first planar conductor 101 for each unit structure 106, whereby the capacitance components are formed. However, unlike the structure shown in FIG. 16 as one example, in each of the island-shaped conductors 1601, the third conductor connection part 1701 is connected to the vicinity of one end of the island-shaped conductor 1601 that spans the opening part 105 in the y-axis direction and one end of the island-shaped conductor 1601 is electrically connected to the first planar conductor 101 by the third conductor connection part 1701.

Similar to the case shown in FIG. 16, for the purpose of compensating for the reduction in capacitance values, which is due to the length of the opening parts 105 becoming shorter for each of the three unit structures 106 in the order of the opening part 105A1, the opening part 105B1, and the opening part 105C1, the areas of the island-shaped conductors 1601 arranged so that they span the opening parts 105 are gradually increased so that the capacitance components that are formed become gradually larger as the lengths of the opening parts 105 become shorter. Therefore, also when the third conductor connection part 1701 is connected to one end of the island-shaped conductor 1601 in the y-axis direction as shown in FIG. 17, the area of the island-shaped conductor 1601 arranged to be opposed to the opening part 105 is changed depending on the length of the opening part 105, whereby it is possible to compensate for the change in the capacitance values due to the change in the length of the opening part 105.

In the configuration example shown in FIG. 17 as one example, the third conductor connection part 1701 is formed of a conductive post or a conductive post array.

Further, the island-shaped conductor 1601 that is arranged substantially at the center of the opening part 105 so as to span the opening part 105 and is connected to the third conductor connection part 1701 may be arranged either on the upper-surface side of the first planar conductor 101 or on the lower-surface side thereof, similar to the case shown in FIG. 16. Further, in the case in which the island-shaped conductor 1601 that is connected to the third conductor connection part 1701 is used as well, the adjustment parameter based on the exactly the same principle as that of the case in which the position of the opening part 105 to which the chip capacitance 1401 is attached is changed according to the length of the opening part 105 in the first modified example of the first exemplary embodiment may be applied.

That is, the position where the island-shaped conductor 1601 that is connected to the third conductor connection part 1701 is arranged is not limited to the vicinity of the center of the opening part 105 and the position on the opening part 105 in which the island-shaped conductor 1601 that is connected to the third conductor connection part 1701 is arranged may be adjusted depending on the length of the opening part 105, whereby it may be possible to compensate for the change in the characteristics of the unit structure 106 due to the change in the length of the opening part 105. Further, also in the case in which the adjustment is performed by the position where the island-shaped conductor 1601 that is connected to the third conductor connection part 1701 is arranged, similar to the case shown in FIG. 16, the area of the island-shaped conductor 1601 may vary depending on the length of the opening part 105 or may be fixed regardless of the length of the opening part 105.

(Third Modified Example of First Exemplary Embodiment)

Next, a third modified example of the first exemplary embodiment will be described. In the third modified example as well, in the case in which the opening part 105 is formed in the linear shape as shown in FIGS. 14 and 15, similar to the case shown in FIG. 17 in the second modified example, the conductive patch and the third conductor connection part are used as the elements that form the capacitance components. However, in the third modified example, the shape of the island-shaped conductor 1601, which is one example of the conductive patch, is different from the rectangular plane shape as shown in FIG. 17. In the third modified example, the conductive patch (e.g., the island-shaped conductor 1601) and the third conductor connection part 1701 form an open stub. The opening part 105 having the linear shape is formed, similar to the cases shown in FIGS. 14 and 15 according to the first modified example and FIGS. 16 and 17 according to the second modified example, in the direction that is perpendicular to the direction in which the unit structures 106 are arranged, that is, in the x-axis direction that is perpendicular to the y-axis direction. In the third modified example as well, the opening part 105 having the linear shape may not be formed in the direction that is perpendicular to the direction in which the unit structures 106 are arranged and the opening part 105 having the linear shape may be tilted by a predetermined angle from the direction in which the unit structures 106 are arranged.

Figure 18:
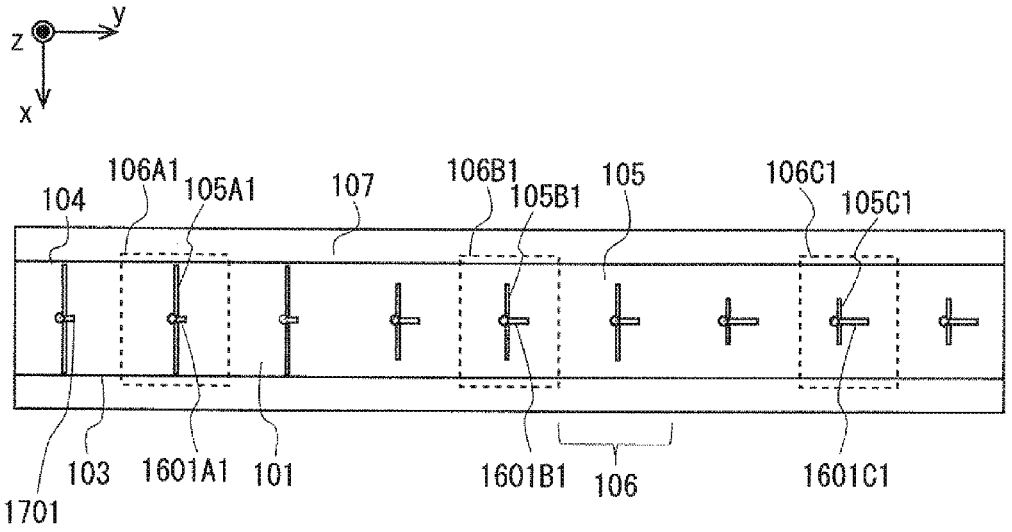
FIG. 18 is a schematic view for describing one example of a structure of the antenna apparatus according to the first exemplary embodiment different from the structures shown in FIGS. 1 and 14 to 17.

FIG. 18 is a schematic view for describing one example of a structure of the antenna apparatus according to the first exemplary embodiment different from the structures shown in FIGS. 1, 14, and 17 and shows an example in which, as the adjustment parameter of the unit structure 106 including the opening part 105 having the linear shape, a conductive patch (e.g., strip-shaped island-shaped conductor 1601) is attached to the vicinity of the center of the opening part 105 so that the conductive patch becomes opposed to the first planar conductor 101 and the third conductor connection part 1701 that electrically connects the strip-shaped island-shaped conductor 1601 and the first planar conductor 101 is attached, so that the open stub is formed and the capacitance components are formed. By electrically connecting the first planar conductor 101 and the strip-shaped island-shaped conductor 1601 by the third conductor connection part 1701 connected to one end of the strip-shaped island-shaped conductor 1601 in the y-axis direction, the island-shaped conductor 1601 and the third conductor connection part 1701 form an open stub using the first planar conductor 101 as a return path. In order to allow the island-shaped conductor 1601, which is one example of the conductive patch, and the third conductor connection part 1701 to operate as the open stub, it is preferable that the third conductor connection part 1701 be provided in the vicinity of the opening part 105 and the third conductor connection part 1701 connect a part in the vicinity of one end of the strip-shaped island-shaped conductor 1601, which is one example of the conductive patch, and the first planar conductor 101. While the case in which the island-shaped conductor 1601 has an elongated strip shape in the y-axis direction is shown in FIG. 17, the island-shaped conductor 1601 may have another shape as long as it can serve as the transmission line.

The capacitance value of the capacitance components to be formed varies depending on the length of the open stub. In the example shown in FIG. 18, when the strip-shaped island-shaped conductor 1601, which is one example of the conductive patch, and the conductor connection part 1701 operate as the open stub, the capacitance value of the capacitance components to be formed typically varies depending on the length of the elongated strip-shaped island-shaped conductor 1601 (as shown in FIG. 18, the length of the strip-shaped island-shaped conductor 1601 in the y-axis direction which is a longer side: the island-shaped conductor 1601 being short in the x-axis direction and long in the y-axis direction).

The example shown in FIG. 18 shows, similar to the case shown in FIG. 16, a case of the antenna apparatus in which nine unit structures 106, each including the opening part 105 having the linear shape, are arranged in the y-axis direction and unit structures 106A1 including opening parts 105A1 whose length of the opening parts 105 is the longest, unit structures 106B1 including opening parts 105B1 whose length of the opening parts 105 is the second longest, and unit structures 106C1 including opening parts 105C1 whose length of the opening parts 105 is the shortest are arranged in order along the y-axis direction in such a way that the lengths of the opening parts 105 become gradually shorter for each of three successive unit structures 106.

In the above case, in order to compensate for the frequency change of the Bloch impedance and the dispersion relation occurring due to the change in the length of the opening part 105, similar to the case shown in FIG. 17, for each of the unit structures 106, the strip-shaped island-shaped conductor 1601 is attached so that one end of the island-shaped conductor 1601 to which the third conductor connection part 1701 (e.g., conductive post) is connected is arranged in the vicinity of the center of each of the opening parts 105. Further, the strip-shaped island-shaped conductor 1601 is attached to the opening part 105 so that the island-shaped conductor 1601 becomes longer in the y-axis direction and the island-shaped conductor 1601 becomes opposed to the first planar conductor 101, whereby the open stub is formed and the capacitance components are formed.

Similar to the case shown in FIG. 17, for the purpose of compensating for the reduction in capacitance values, which is due to the length of the opening parts 105 becoming shorter for each of the three unit structures 106 in the order of the opening part 105A1, the opening part 105B1, and the opening part 105C1, the length of the y-axis direction of the island-shaped conductor 1601 having one end connected to the third conductor connection part 1701 in the vicinity of the opening part 105 is gradually increased so that the effective capacitance value of the capacitance components that are formed becomes gradually larger as the length of the opening part 105 becomes shorter.

That is, shortest island-shaped conductors 1601A1 are arranged in the opening parts 105A1 of the unit structures 106A1 whose length of the opening parts 105 is the longest, second shortest island-shaped conductors 1601B1 are arranged in the opening parts 105B1 of the unit structures 106B1 whose length of the opening parts 105 is the second longest, and longest island-shaped conductors 1601C1 are arranged in the opening parts 105C1 of the unit structures 106C1 whose length of the opening parts 105 is the shortest. Therefore, by changing the length of the open stub, that is, the length of the strip-shaped island-shaped conductor 1601 arranged in the opening part 105 depending on the length of the opening part 105, it is possible to compensate for the change in the capacitance values due to the change in the lengths of the opening part 105.

In the configuration example shown in FIG. 18 as one example, the third conductor connection part 1701 is formed of a conductive post array.

Further, the island-shaped conductor 1601 that has one end substantially at the center of the opening part 105 and is connected to the third conductor connection part 1701 may be arranged either on the upper-surface side of the first planar conductor 101 or on the lower-surface side thereof, similar to the case shown in FIG. 16. Further, also when the third conductor connection part 1701 and the strip-shaped island-shaped conductor 1601 form the open stub, the adjustment parameter based on the exactly the same principle as that of the case in which the position of the opening part 105 to which the chip capacitance 1401 is attached is changed according to the length of the opening part 105 in the first modified example of the first exemplary embodiment may be applied.

That is, the position where the island-shaped conductor 1601 that is connected to the third conductor connection part 1701 is arranged is not limited to the vicinity of the center of the opening part 105 and the position on the opening part 105 in which the island-shaped conductor 1601 that is connected to the third conductor connection part 1701 is arranged may be adjusted depending on the length of the opening part 105, whereby it may be possible to compensate for the change in the characteristics of the unit structure 106 due to the change in the length of the opening part 105. Further, when the adjustment is performed by the position where the island-shaped conductor 1601 that is connected to the third conductor connection part 1701 is arranged, similar to the case shown in FIG. 16, the shape and the length of the island-shaped conductor 1601 may vary depending on the length of the opening part 105 or they may be fixed regardless of the length of the opening part 105.

(Fourth Modified Example of First Exemplary Embodiment)

In the aforementioned description of the antenna apparatus according to the first exemplary embodiment, the structure in which it becomes possible to control the radiation efficiency per antenna length by changing the length of the part of the opening part 105 which contributes to the radiation of the electromagnetic waves according to the unit structures 106 that have been arranged has been described. However, the present invention is not limited to this case. Naturally, it may be possible to obtain the similar effects even when the shape of the opening part 105 is changed by another method.

(Fifth Modified Example of First Exemplary Embodiment)

In the aforementioned description of the antenna apparatus according to the first exemplary embodiment, the case in which the opening 802, which contributes to the radiation of the electromagnetic waves of the opening part 105, is formed in the x-axis direction, which is perpendicular to the y-axis direction, which is the direction in which the unit structures 106 are arranged or the direction in which power propagates through the waveguide that forms the antenna. In this case, regarding polarized waves of the electromagnetic waves radiated from the antenna apparatus, polarized waves in the power propagation direction (y-axis direction) of the waveguide are radiated. The antenna apparatus according to the present invention is not limited to such a case. When the opening part 105 is formed to have a meandering shape, for example, as shown in FIG. 19, a structure in which the opening part 802 that contributes to the radiation of the opening part 105 is tilted in the x-axis direction by a predetermined angle with respect to the direction in which the unit structures 106 are arranged, that is, the power propagation direction of the waveguide that forms the antenna, or in other words, the y-axis direction, which is the longitudinal direction of the line, may be employed.

Figure 19:
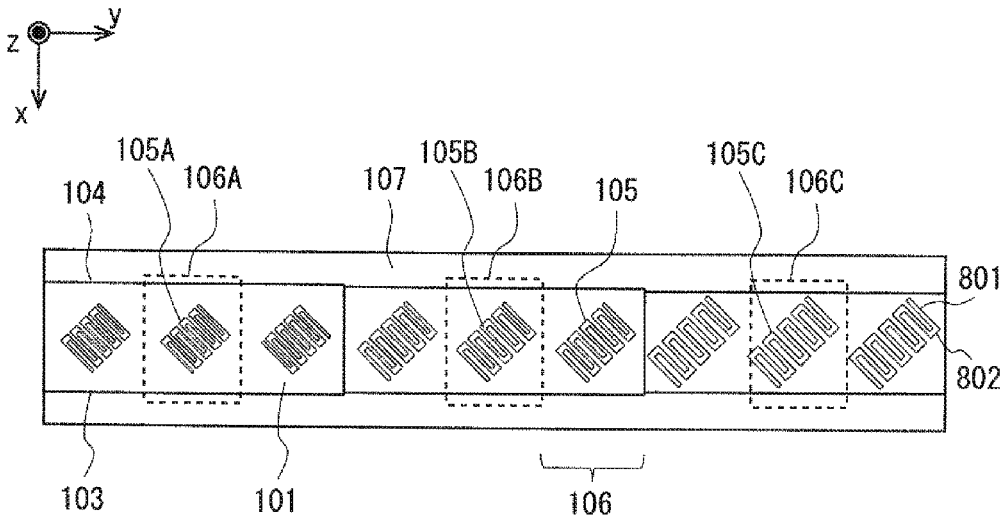
FIG. 19 is a schematic view showing an example of the plan view of the antenna apparatus according to the first exemplary embodiment different from FIG. 2.

FIG. 19 is a schematic view of the plan view of the antenna apparatus according to the first exemplary embodiment different from that shown in FIG. 2 and shows a case in which the opening part 105 is tilted by 45 degrees in the x-axis direction from the y-axis direction, which is a direction in which the unit structures 106 are arranged or the power propagation direction of the waveguide that forms the antenna. The polarized waves of the electromagnetic waves radiated from the antenna apparatus that includes the opening part 105 that is tilted is tilted by 45 degrees in the x-axis direction from the y-axis direction according to the tilt angle of the opening part 105.

The tilt angle of the opening part 105 is not limited to 45 degrees and it is needless to say that the opening part 105 may have a desired tilt angle as long as the opening part 105 is excited by the electromagnetic waves propagating through the waveguide. Further, the shape of the opening part 105 that is tilted is not limited to the meandering shape and the opening part 105 may have a desired shape. The opening part 105 may have, for example, a linear shape.

Figure 20:
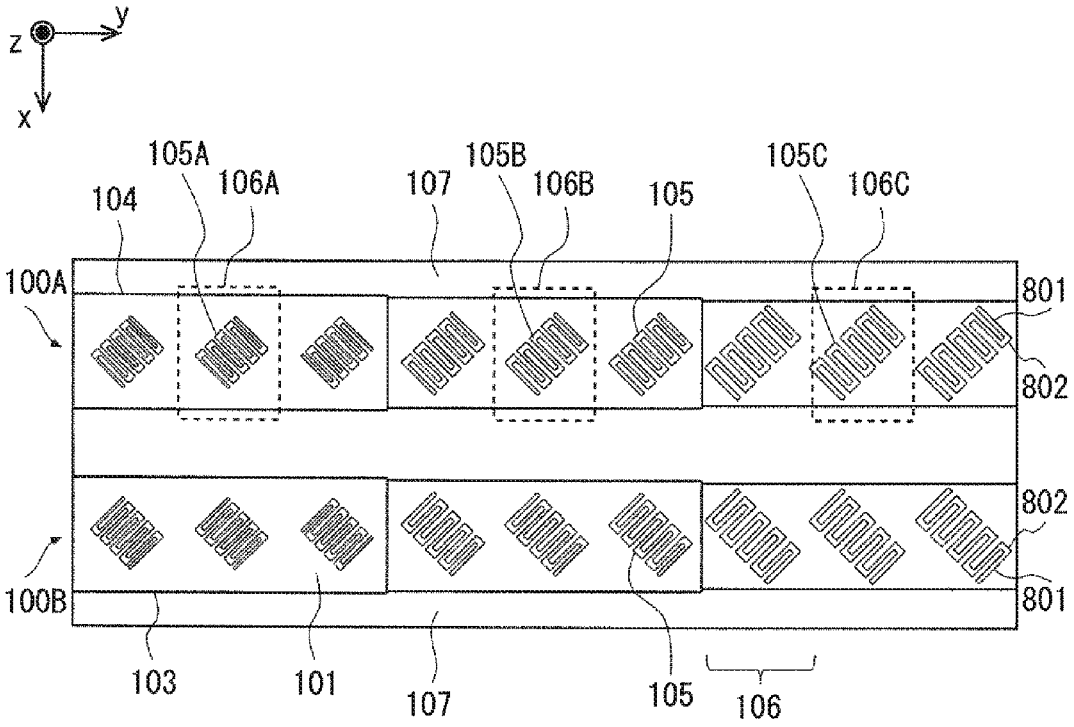
FIG. 20 is a schematic view showing an example of the plan view of the antenna apparatus according to the first exemplary embodiment different from that shown in FIG. 19.

Further, the antenna apparatus as shown in FIG. 20 may be formed. FIG. 20 is a schematic view showing an example of the plan view of the antenna apparatus according to the first exemplary embodiment different from that shown in FIG. 19 and shows a case in which the antenna apparatus is formed by combining two types of antenna apparatuses (waveguides) shown in FIG. 19 including the opening part 105 having a tilt in the openings 802 that contribute to the radiation. In the antenna apparatus shown in FIG. 20, the opening parts 105 arranged in an upper waveguide 100A are tilted by 45 degrees in the x-axis direction from the y-axis direction, similar to the case shown in FIG. 19, and the opening parts 105 arranged in a lower waveguide 100B are tilted by the angle the same as that of the opening parts 105 in the upper waveguide 100A in the opposite direction, that is, tilted by −45 degrees in the x-axis direction from the y-axis direction.

In the antenna apparatus including the two waveguides 100A and 100B, it is possible to obtain desired polarized waves by adjusting the phase difference between the power input to the waveguide 100A and the power input to the waveguide 100B while obtaining the aforementioned effect that it becomes possible to control the radio wave radiation amount per antenna length. When the power input to the waveguide 100A and the power input to the waveguide 100B have the same phase, the electromagnetic waves radiated from the antenna apparatus become the linearly polarized wave in the power propagation direction of the waveguides 100A and 100B, that is, in the y-axis direction. Further, when the power input to the waveguide 100A and the power input to the waveguide 100B have a phase difference of 180 degrees, the electromagnetic waves radiated from the antenna apparatus become the linearly polarized wave in the direction perpendicular to the power propagation direction (y-axis direction) of the waveguides 100A and 100B, that is, the x-axis direction. Further, when the power input to the waveguide 100A and the power input to the waveguide 100B have a phase difference of 90 degrees or 270 degrees, the electromagnetic waves radiated from the antenna apparatus becomes circularly polarized wave.

Figure 21:
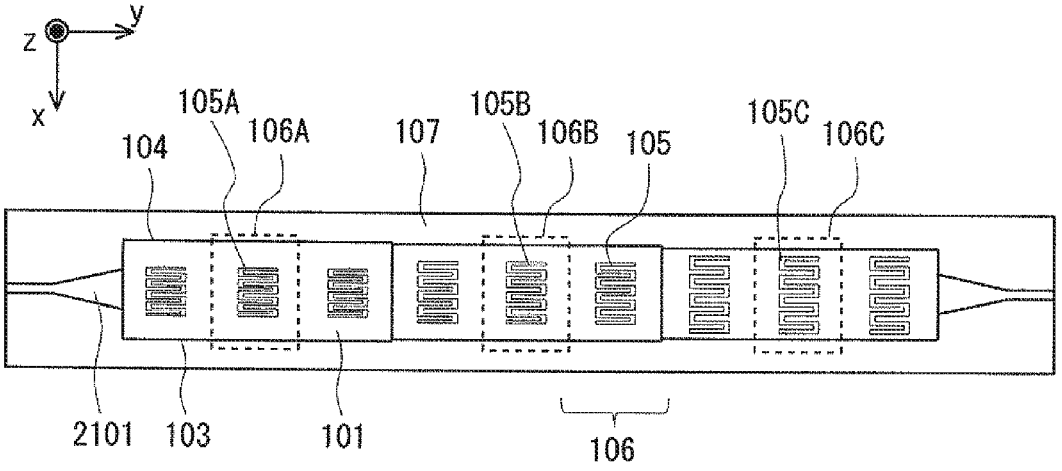
FIG. 21 is a schematic view showing one example of a case in which an impedance conversion is performed in the antenna apparatus that forms a waveguide part using a dielectric substrate.

Since the input impedance of the waveguide part of the antenna apparatus does not generally become 50Ω, the impedance conversion is preferably performed using an impedance converter also in the antenna apparatus according to the first exemplary embodiment, similar to the case of the normal antenna apparatus. When the waveguide part is formed using the dielectric substrate, for example, an impedance conversion by a matching circuit by chip components, an impedance conversion that uses a stub, an impedance conversion that uses a ¼ wavelength line may be used or an impedance conversion method as shown in FIG. 21 may be employed. FIG. 21 is a schematic view showing one example of the case in which the impedance conversion is performed in the antenna apparatus that forms the waveguide part using the dielectric substrate and shows one example in which a funnel-shaped tapered line 2101 is inserted between the antenna apparatus and the microstrip line described in the first exemplary embodiment and the impedance conversion is performed.

Second Exemplary Embodiment

Next, with reference to the drawings, a second exemplary embodiment of the antenna apparatus of the present invention will be described in detail. In the second exemplary embodiment, one example of an antenna apparatus capable of radiating electromagnetic waves having a uniform intensity distribution is shown.

(Structure of Antenna Apparatus According to Second Exemplary Embodiment)

Figure 22:
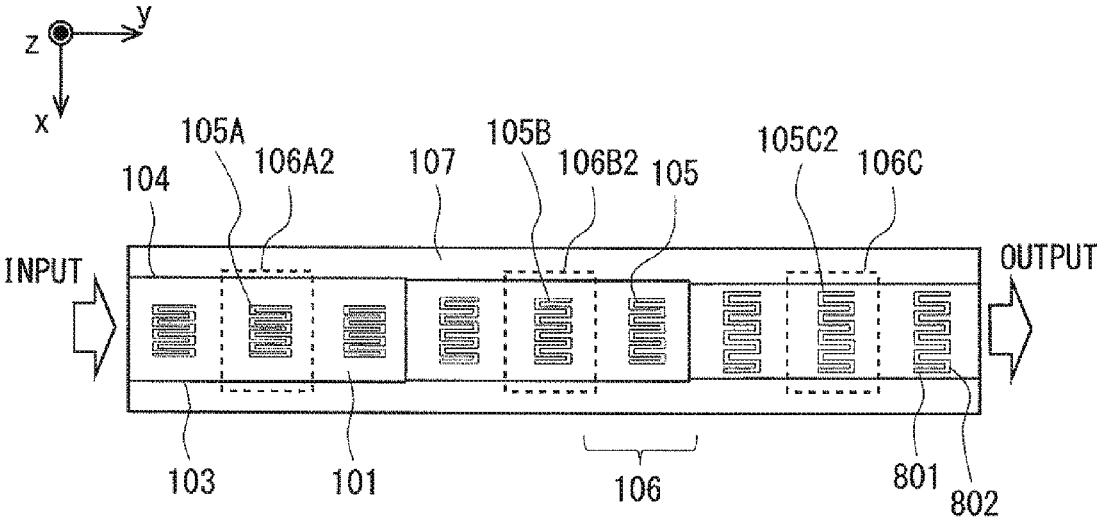
FIG. 22 is a schematic view showing one example of a plan view of an antenna apparatus according to a second exemplary embodiment of the present invention.

First, with reference to FIG. 22, a structure of the second exemplary embodiment of the antenna apparatus according to the present invention will be described. FIG. 22 is a schematic view showing one example of a plan view of the antenna apparatus according to the second exemplary embodiment of the present invention and shows a case in which the opening part has a meandering shape, similar to FIGS. 1 to 3 in the first exemplary embodiment. The antenna apparatus shown in FIG. 22 as the second exemplary embodiment is a modified example of the antenna apparatus shown in FIG. 1 in the above first exemplary embodiment and components similar to those of the aforementioned first exemplary embodiment are denoted by the reference symbols the same as those in FIGS. 1 to 3 and overlapping descriptions will be omitted.

In the antenna apparatus according to the first exemplary embodiment, the antenna apparatus according to the present invention includes at least two types of unit structures 106 whose shapes of the opening parts 105 are different from each other, and it is possible to control the electromagnetic wave radiation efficiency per antenna length according to the shape of the opening part 105.

In addition thereto, FIG. 22 according to the second exemplary embodiment shows a diagram in which a power input end and a power output end are newly specified for the antenna apparatus according to the first exemplary embodiment shown in FIG. 2 and shows one example of the antenna apparatus according to the second exemplary embodiment. In the antenna apparatus shown in FIG. 22 as one example, the length of the opening 802 that contributes to the radiation of the electromagnetic waves of the opening part 105 is formed to be gradually longer in the order from an opening part 105A2, an opening part 105B2, and an opening part 105C2 from the side of the input end to the side of the output end and the radiation efficiency per antenna length is formed to gradually increase.

(Basic Operation Principles of Structure of Antenna Apparatus According to Second Exemplary Embodiment and Effects Thereof)

Next, basic operation principles of the antenna apparatus according to the second exemplary embodiment shown in FIG. 22 will be described. In a normal leaky wave antenna, power is gradually radiated into the space as the electromagnetic waves propagate through the transmission line. Therefore, the power radiation amount in the case of the leaky wave antenna formed of the normal composite right/left-handed transmission line in which the same unit structures are repeatedly arranged becomes large in the vicinity of the power input end and becomes small in the vicinity of the power output end. This causes directional patterns of the electromagnetic waves that are radiated to be distorted.

On the other hand, in the antenna apparatus according to the second exemplary embodiment shown in FIG. 22, the unit structures 106 whose shapes of the opening parts 105 are changed are arranged along the power propagation direction (y-axis direction) in order to compensate for the change in the power radiation amount due to the change in the power propagation amount in the transmission line. While the amount of power propagating through the transmission line gradually decreases as the power propagates, in the antenna apparatus according to the second exemplary embodiment shown in FIG. 22, the length of the opening 802 that contributes to the radiation of the electromagnetic waves of the opening part 105 is formed to be longer in the order from the opening part 105A2, the opening part 105B2, and the opening part 105C2 from the side of the power input end to the side of the power output end and the radiation efficiency per antenna length is increased, whereby the amount of decrease in the power is compensated. In other words, in the antenna apparatus according to the second exemplary embodiment, compared to the leaky wave antenna formed of the typical composite right/left-handed transmission line in which the same unit structures are repeatedly arranged, it is possible to obtain the radio wave radiation amount in which the electric field intensity distribution is uniform along the antenna length direction, and to obtain the antenna apparatus in which the distortion of the directional patterns is small.

While the shape of the opening part 105 has a meandering shape in the antenna apparatus shown in FIG. 22, it is also possible to obtain the antenna apparatus according to the second exemplary embodiment by employing a desired shape based on another configuration described in the first exemplary embodiment as the modified example.

Third Exemplary Embodiment

Next, with reference to the drawings, a third exemplary embodiment of the antenna apparatus according to the present invention will be described in detail. In the third exemplary embodiment, one example of an antenna apparatus capable of radiating electromagnetic waves having an intensity distribution that is close to the Gaussian distribution is shown.

(Structure of Antenna Apparatus According to Third Exemplary Embodiment)

Figure 23:
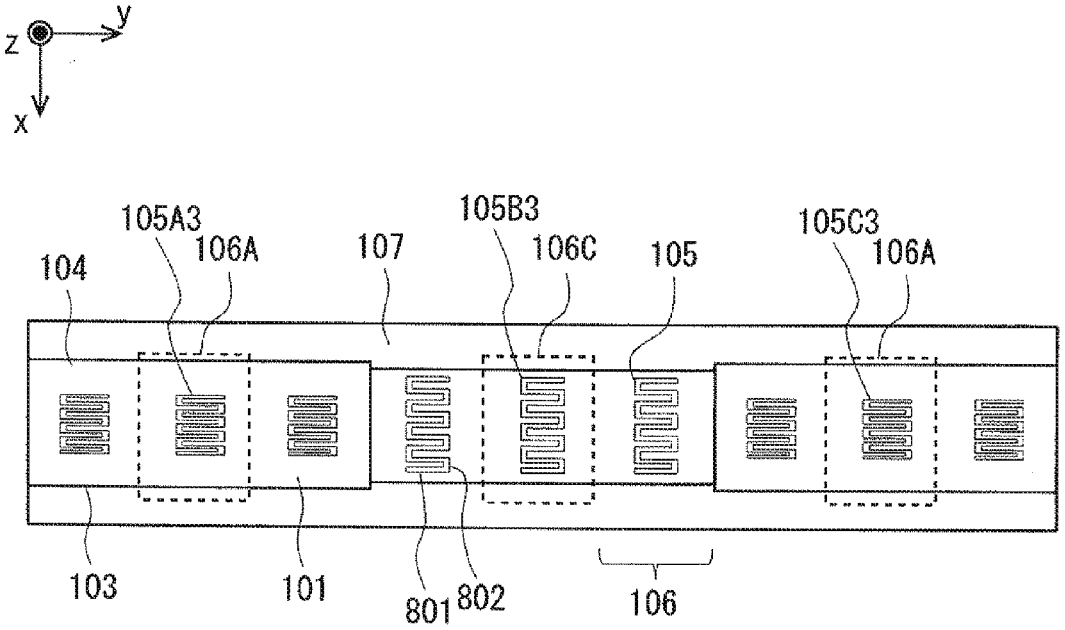
FIG. 23 is a schematic view showing one example of a plan view of an antenna apparatus according to a third exemplary embodiment of the present invention.

With reference to FIG. 23, a structure of the third exemplary embodiment of the antenna apparatus according to the present invention will be described. FIG. 23 is a schematic view showing one example of a plan view of the antenna apparatus according to the third exemplary embodiment of the present invention and shows a case in which the opening part is formed to have the meandering shape, which is the same as the first exemplary embodiment shown in FIGS. 1 to 3. The antenna apparatus shown in FIG. 23 as the third exemplary embodiment is also a modified example of the antenna apparatus shown in FIG. 1 according to the aforementioned first exemplary embodiment and the components the same as those of the aforementioned first exemplary embodiment are denoted by the reference symbols the same as those shown in FIGS. 1 to 3 and overlapping descriptions will be omitted.

The antenna apparatus according to the first exemplary embodiment of the present invention includes at least two types of unit structures 106 whose shapes of the opening parts 105 are different from each other. It is possible to control the electromagnetic wave radiation efficiency per antenna length according to the shape of the opening part 105.

In addition thereto, FIG. 23 according to the third exemplary embodiment shows one example of the antenna apparatus in which, in the area around the power input end and the power output end of the antenna, that is, the area around the antenna end parts, the power radiation amount is controlled to become relatively lower than that in the area around the antenna central part, using the fact that the radiation efficiency per antenna length can be controlled according to the shape of the opening part 105. That is, in the antenna apparatus shown in FIG. 23 as one example, the shape of the opening part 105 is changed from an opening part 105A3, an opening part 105B3, and an opening part 105C3 from the input end to the output end, the length of the opening 802 that contributes to the radiation of the electromagnetic waves of the opening part 105 is formed to be short in the opening part 105A3 which is in the vicinity of the input end or in the opening part 105C3 which is in the vicinity of the output end, which is around the vicinity of the antenna end part and to be long in the opening part 105B3 which is in the vicinity of the center of the antenna length direction, and the distribution of the radiation efficiency per antenna length is close to the Gaussian distribution.

Figure 24:
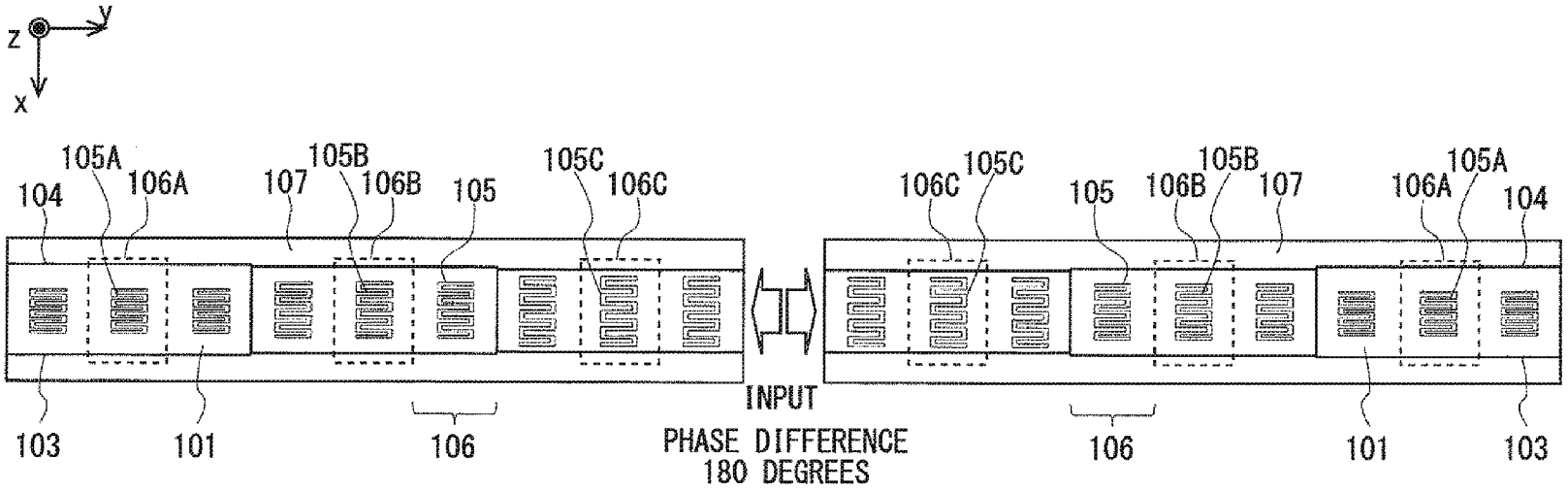
FIG. 24 is a schematic view showing another example of the plan view of the antenna apparatus according to the third exemplary embodiment of the present invention.

Further, according to the structure shown in FIG. 24, it is expected that the effect of the third exemplary embodiment can be obtained more easily than in the structure shown in FIG. 23. FIG. 24 is a schematic view showing another example of the plain view of the antenna apparatus according to the third exemplary embodiment of the present invention. As described above, in the normal leaky wave antenna, power is gradually radiated into the space as the electromagnetic waves propagate through the transmission line. Therefore, the power radiation amount in the case of the leaky wave antenna formed of the normal composite right/left-handed transmission line in which the same unit structures are repeatedly arranged becomes large in the vicinity of the power input end and becomes small in the vicinity of the power output end. By using this property, it is possible to obtain the leaky wave antenna according to the present invention that has a distribution of the radio wave radiation amount that is close to the Gaussian distribution more easily. That is, in the antenna apparatus shown in FIG. 24 as one example, two leaky wave antenna apparatuses are arranged and the shape of the opening part is changed from the input end to the output end. Since the leaky wave antenna originally has the property that the power radiation amount becomes large in the area around the power input end and the power radiation amount becomes small in the area around the power output end, it is possible to obtain the distribution of the radiation amount that is close to the Gaussian distribution more easily than that according to the configuration shown in FIG. 23 as one example by using this property. In this case, it is required to apply excitation with the phase difference of 180 degrees in order to prevent the radio waves to be radiated from disappearing due to the interference.

(Basic Operation Principles of Structure of Antenna Apparatus According to Third Exemplary Embodiment and Effects Thereof)

Next, the basic operation principles of the antenna apparatus according to the third exemplary embodiment shown in FIG. 23 will be described. In the antenna apparatus according to the third exemplary embodiment shown in FIG. 23, the length of the opening 802 that contributes to the radiation of the electromagnetic waves becomes gradually longer from the both end parts of the antenna (e.g., the power input end and the power output end) to the central part of the antenna. It is therefore possible to control the power radiation amount per antenna length so that the power radiation amount distribution becomes close to the Gaussian distribution in which peak appears in the area around the antenna central part. In general, it is known in the field of the array antenna that when the input power ratio of each antenna element is determined according to the Gaussian distribution (binomial distribution), it is possible to obtain the directional patterns that do not include side lobe components. According to the configuration of the third exemplary embodiment shown in FIG. 23, the leaky wave antenna having the power radiation amount distribution that is close to the Gaussian distribution can be obtained. It is therefore possible to obtain the antenna apparatus in which the side lobe level is low according to the antenna apparatus according to the third exemplary embodiment.

Further, as is known in the field of the array antenna, it becomes possible to control the side lobe level and the main beam width by adjusting the shape of the opening part 105 to obtain the power radiation amount that complies with the Chebyshev polynomials or the Taylor distribution. That is, by adjusting the shape of the opening part 105 to obtain the radio wave radiation amount that complies with the Chebyshev polynomials or the Taylor distribution also in the antenna apparatus according to the present invention, it becomes possible to obtain the leaky wave antenna that achieves the power radiation amount that complies with the Chebyshev polynomials or the Taylor distribution.

It should be noted that, while the preferable exemplary embodiments of the present invention have been described above, they are merely examples of the present invention and do not limit the present invention. It will be understood by those skilled in the art that various changes may be made on the exemplary embodiments depending on specific applications within the scope of the present invention.

This application is based upon and claims the benefit of priority from Japanese Patent Application No. 2014-19266, filed on Feb. 4, 2014, the disclosure of which is incorporated herein in its entirety by reference.

REFERENCE SIGNS LIST

100A WAVEGUIDE
100B WAVEGUIDE
101 FIRST PLANAR CONDUCTOR
102 SECOND PLANAR CONDUCTOR
103 FIRST CONDUCTOR CONNECTION PART
104 SECOND CONDUCTOR CONNECTION PART
105 OPENING PART
105A OPENING PART
105A1 OPENING PART
105A2 OPENING PART
105A3 OPENING PART
105B OPENING PART
105B1 OPENING PART
105B2 OPENING PART
105B3 OPENING PART
105C OPENING PART
105C1 OPENING PART
105C2 OPENING PART
105C3 OPENING PART
106 UNIT STRUCTURE
106A UNIT STRUCTURE
106A1 UNIT STRUCTURE
106B UNIT STRUCTURE
106B1 UNIT STRUCTURE
106C UNIT STRUCTURE
106C1 UNIT STRUCTURE
107 DIELECTRIC
801 OPENING (ONE LINE ELEMENT THAT DOES NOT CONTRIBUTE TO RADIATION OF ELECTROMAGNETIC WAVES OF OPENING PART 105)
802 OPENING (THE OTHER LINE ELEMENT THAT CONTRIBUTES TO RADIATION OF ELECTROMAGNETIC WAVES OF OPENING PART 105)
1401 CHIP CAPACITANCE
1401A CHIP CAPACITANCE
1401A1 CHIP CAPACITANCE
1401B CHIP CAPACITANCE
1401B1 CHIP CAPACITANCE
1401C CHIP CAPACITANCE
1401C1 CHIP CAPACITANCE
1601 ISLAND-SHAPED CONDUCTOR
1601A ISLAND-SHAPED CONDUCTOR
1601A1 ISLAND-SHAPED CONDUCTOR
1601B ISLAND-SHAPED CONDUCTOR
1601B1 ISLAND-SHAPED CONDUCTOR
1601C ISLAND-SHAPED CONDUCTOR
1601C1 ISLAND-SHAPED CONDUCTOR
1701 THIRD CONDUCTOR CONNECTION PART (CONDUCTIVE POST)
2101 TAPERED LINE
L LENGTH OF OPENING
$L_1$ INDUCTANCE
$L_2$ INDUCTANCE
$L_3$ INDUCTANCE
$L_4$ INDUCTANCE
$L_5$ INDUCTANCE
$L_6$ INDUCTANCE
$C_1$ CAPACITANCE
$C_2$ CAPACITANCE
$C_5$ CAPACITANCE

What is claimed is:

1. An antenna comprising unit structures, wherein each unit structure comprising: a first planar conductor, a second planar conductor, a first conductor connection part, and a second conductor connection part, wherein the first planar conductor and the second planar conductor are: arranged in different layers, disposed opposite to each other, electrically connected via the first conductor connection part, and electrically connected via the second conductor connection part, and the first planar conductor comprises: an opening in a region between the first conductor connection part and the second conductor connection part, and the unit structures: are arranged in a direction perpendicular to a direction of a line connecting the first conductor connection part and the second conductor connection part so that each of the first planar conductor and the second planar conductor of the unit structure forms one plane, and comprise at least two types of the opening, the shape of which are different from each other.

2. The antenna according to claim 1, wherein the at least two types of the opening are different from each other in terms of length in the direction of the line.

3. The antenna according to claim 2, wherein a length in the direction of the line of the opening of the unit structure arranged at a side of a power input end is longer than a length in the direction of the line of the opening of the unit structure arranged at a side of a power output end.

4. The antenna according to claim 2, wherein a length in the direction of the line of the opening of the unit structure arranged close to a center of the antenna is longer than a length in the direction of the line of the opening of the unit structure arranged far from the center of the antenna.

5. The antenna according to claim 1, wherein a shape of the opening is meandering.

6. The antenna according to claim 1, wherein each unit structure comprising:

at least one chip capacitance across the opening.

7. The antenna according to claim 1, wherein each unit structure comprising:

a conductive patch across the opening, wherein the conductive patch is disposed opposite to the first planar conductor.

8. The antenna according to claim 7, wherein each unit structure comprising:

a conductive via which connects the conductive patch and the first planar conductor.

9. The antenna according to claim 1 comprises:

at least two types of the unit structures, which are different from each other in terms of distance between the first conductor connection part and the second conductor connection part.

10. The antenna according to claim 1, wherein at least one of the first conductor connection part and the second conductor connection part is formed of a conductive post array.

* * * * *